US010371332B2

(12) United States Patent
Bailey

(10) Patent No.: US 10,371,332 B2
(45) Date of Patent: Aug. 6, 2019

(54) LIGHTING SYSTEMS UTILIZING INTERCONNECTED MODULES FOR USE WITH GRID CEILINGS AND SURFACES

(71) Applicant: George R. Bailey, Baltimore, MD (US)

(72) Inventor: George R. Bailey, Baltimore, MD (US)

( * ) Notice: Subject to any disclaimer, the term of this patent is extended or adjusted under 35 U.S.C. 154(b) by 124 days.

(21) Appl. No.: 15/342,522

(22) Filed: Nov. 3, 2016

(65) Prior Publication Data

US 2017/0074474 A1 Mar. 16, 2017

Related U.S. Application Data

(63) Continuation of application No. PCT/US2015/029976, filed on May 8, 2015.
(Continued)

(51) Int. Cl.

| | |
|---|---|
| ***E04B 9/00*** | (2006.01) |
| ***E04B 9/06*** | (2006.01) |
| ***E04B 9/18*** | (2006.01) |
| ***F21S 2/00*** | (2016.01) |
| ***F21S 4/28*** | (2016.01) |
| ***F21S 8/04*** | (2006.01) |
| ***F21V 3/00*** | (2015.01) |

(Continued)

(52) U.S. Cl.
CPC ..... *F21S 8/04* (2013.01); *E04B 9/006* (2013.01); *E04B 9/067* (2013.01); *E04B 9/18* (2013.01); *F21S 2/005* (2013.01); *F21S 4/28* (2016.01); *F21V 3/00* (2013.01); *F21V 15/015* (2013.01); *F21V 17/16* (2013.01); *F21V 19/003* (2013.01); *F21V 23/02* (2013.01); *F21V 23/06* (2013.01); *F21Y 2115/10* (2016.08)

(58) Field of Classification Search
CPC .... F21S 8/04; F21S 8/043; F21S 8/046; F21S 8/066; F21S 4/28; F21S 2/005; E04B 9/006; E04B 9/18; E04B 9/067; F21V 23/06; F21V 5/04; F21V 5/043; F21V 5/048; F21V 19/003; F21V 15/015; F21V 3/00; F21Y 2103/10
See application file for complete search history.

(56) References Cited

U.S. PATENT DOCUMENTS 4,338,653 A * 7/1982 Marrero ..... F21S 8/037 362/147
7,083,298 B2 8/2006 Pritchard et al.
(Continued)

*Primary Examiner* — Erin Kryukova
(74) *Attorney, Agent, or Firm* — Lando & Anastasi, LLP

(57) ABSTRACT

A lighting system for a grid ceiling that includes a plurality of T-bar sections interconnected at an intersection region of the grid ceiling, and includes a lighting module and a connection module. The lighting module and connection module are constructed and arranged to be disposed proximate a first T-bar section of the plurality of T-bar sections and the intersection region of the grid ceiling, respectively. The lighting module has a first end and a second end and includes at least one low voltage light source electrically connected to a conductive surface of a substrate and a connector disposed on the conductive surface of the substrate proximate the first end. The connection module includes a substrate and a connector disposed on a conductive surface of the substrate, and is configured to electrically and mechanically couple to the second end of the lighting module to transfer power to or from the lighting module.

26 Claims, 29 Drawing Sheets

Related U.S. Application Data

(60) Provisional application No. 61/990,547, filed on May 8, 2014.

(51) Int. Cl.

| | |
|---|---|
| ***F21V 17/16*** | (2006.01) |
| ***F21V 19/00*** | (2006.01) |
| ***F21V 23/02*** | (2006.01) |
| ***F21V 23/06*** | (2006.01) |
| ***F21V 15/015*** | (2006.01) |
| ***F21Y 115/10*** | (2016.01) |

(56) References Cited

U.S. PATENT DOCUMENTS

| | | | | |
|---|---|---|---|---|
| 7,178,941 | B2 | 2/2007 | Roberge et al. | |
| 7,358,929 | B2 | 4/2008 | Mueller et al. | |
| 7,753,577 | B2 | 7/2010 | Teeters | |
| 8,177,385 | B2 | 5/2012 | Porciatti | |
| 8,262,250 | B2 | 9/2012 | Li et al. | |
| 8,272,764 | B2 * | 9/2012 | Son | F21V 3/02 362/294 |
| 8,313,212 | B1 | 11/2012 | Mayer et al. | |
| 8,459,824 | B1 | 6/2013 | Esmailzadeh et al. | |
| 3,545,045 | A1 | 10/2013 | Tress | |
| 8,794,795 | B2 | 8/2014 | Yaphe et al. | |
| 9,145,678 | B1 * | 9/2015 | Wang | E04B 9/006 |
| 2004/0213003 | A1 * | 10/2004 | Lauderdale | E04B 9/006 362/404 |
| 2006/0262521 | A1 | 11/2006 | Piepgras et al. | |
| 2008/0037284 | A1 * | 2/2008 | Rudisill | F21S 2/005 362/629 |
| 2010/0103654 | A1 * | 4/2010 | Yasuda | E04B 9/006 362/147 |
| 2010/0271804 | A1 * | 10/2010 | Levine | F21V 21/005 362/35 |
| 2011/0222270 | A1 * | 9/2011 | Porciatti | E04B 9/006 362/147 |
| 2011/0286207 | A1 * | 11/2011 | Chan | F21V 15/013 362/217.1 |
| 2013/0044501 | A1 * | 2/2013 | Rudisill | F21V 29/70 362/398 |
| 2013/0083514 | A1 * | 4/2013 | Wong | F21S 8/046 362/147 |
| 2013/0170238 | A1 * | 7/2013 | Diekmann | F21S 2/005 362/382 |
| 2013/0294061 | A1 | 11/2013 | Sorensen et al. | |
| 2013/0294079 | A1 | 11/2013 | Tran et al. | |
| 2014/0063803 | A1 * | 3/2014 | Yaphe | F21V 15/012 362/247 |
| 2014/0126196 | A1 | 5/2014 | Dixon et al. | |
| 2014/0126199 | A1 | 5/2014 | Heeter et al. | |
| 2014/0226316 | A1 | 8/2014 | Medendorp, Jr. et al. | |
| 2014/0268727 | A1 * | 9/2014 | Amrine, Jr. | F21K 9/17 362/224 |
| 2015/0138772 | A1 * | 5/2015 | Hanslip | F21V 21/005 362/249.06 |
| 2015/0276137 | A1 * | 10/2015 | Demuynck | F21K 9/175 362/218 |

* cited by examiner

LIGHTING SYSTEMS UTILIZING INTERCONNECTED MODULES FOR USE WITH GRID CEILINGS AND SURFACES

CROSS-REFERENCE TO RELATED APPLICATIONS

This application is a continuation of and claims priority under 35 U.S.C. § 120 to International Application No. PCT/US2015/029976, filed May 8, 2015, titled "LED LIGHTING SYSTEMS AND METHODS OF INSTALLATION," which claims the benefit of priority under 35 U.S.C. § 119(e) and PCT Article 8 to U.S. Provisional Application Ser. No. 61/990,547 titled "LED LIGHTING SYSTEMS AND METHODS OF INSTALLATION," filed May 8, 2014, each of which is hereby incorporated by reference herein in its entirety for all purposes.

BACKGROUND

Technical Field

The technical field relates generally to low voltage fixtures, and more specifically, to low voltage fixtures, such as LED lighting assemblies, for use with suspended ceiling systems.

Background Discussion

Grid ceiling systems, often termed "suspended ceiling systems," "dropped ceilings," or simply "grid ceilings," are commonly used in commercial buildings, schools, residential homes, and other interior structures. These ceiling systems are created by suspending a T-bar grid from the building's structural ceiling and filling the T-bar grid with ceiling tiles. The T-bar grid is made up of interconnected T-bars, otherwise referred to as "T-bar sections" that form grid openings for the ceiling tiles, which, when dropped into the grid openings, are supported on the T-bars' bottom horizontal T-walls. Common dimensions for the grid openings include 2×2 foot and 2×4 foot dimensions for supporting similarly sized ceiling tiles. However, other grid opening dimensions are possible for accommodating different ceiling tile sizes, for example 5×5 foot and 2×4 foot tiles. Ceiling tiles used in grid ceilings are typically acoustic tiles for enhancing the acoustical environment of the interior space below the grid ceiling.

Lighting assemblies can be provided in the grid ceiling system for general illumination. One type of lighting assembly that is adapted for a grid ceiling structure is called a troffer. Troffers usually include fluorescent light sources, however, other light sources, such as incandescent and high intensity discharge (HID) lamps may also be used. Troffers are sized in correspondence with the grid openings of the T-bar grid and are mounted in selected grid openings instead of a ceiling tile. Because of their weight, troffers are typically suspended from the building's structural ceiling independently of the T-bar grid.

Lighting fixtures based on the light emitting diode (LED) serve as an alternative to fluorescent or incandescent light sources because of their potential for improved energy efficiency, their low voltage DC operation, their freedom from hazardous materials such as mercury, their lack of infrared and UV radiation, their ease of dimming, their ease of color adjustment, and their long service life. For example, at equal power, LEDs give far more light output than do incandescent bulbs; and their operational life is orders of magnitude larger, namely 10-100 thousand hours vs. 1-2 thousand hours. However, adaption or installation of LEDs into current troffer arrangements typically requires the services of a professional electrician, which can increase the expense and complexity of a lighting project.

SUMMARY

Embodiments of the present invention are directed to a lighting system for a grid ceiling that includes a plurality of T-bar sections interconnected at an intersection region of the grid ceiling. The lighting system comprises a first lighting module having a first end and a second end, the first lighting module including at least one low voltage light source electrically connected to a conductive surface of a first substrate and a first connector disposed on the conductive surface of the first substrate proximate the first end of the first lighting module, the first lighting module being constructed and arranged to be disposed proximate a first T-bar section of the plurality of T-bar sections. The lighting system also includes a first connection module including a second substrate and a second connector disposed on a conductive surface of the second substrate, the first connection module being configured to electrically and mechanically couple to the second end of the first lighting module to transfer power to or from the first lighting module, the first connection module being constructed and arranged to be disposed proximate the intersection region of the grid ceiling.

In one embodiment, the first lighting module and the first connection module are formed on a common substrate, and wherein the common substrate includes at least one separation feature that permits the first substrate of the first lighting module to be physically separated from the second substrate of the first connection module. In a further embodiment, the first lighting module further includes a third connector disposed on the conductive surface of the first substrate proximate a second end of the first lighting module that is opposite the first end and adjacent the at least one separation feature. In a further embodiment, the first connection module includes at least one low voltage light source electrically connected to the conductive surface of the second substrate. In a further embodiment, the lighting system further comprises a second lighting module having a first end and a second end, the second lighting module including at least one low voltage light source electrically connected to a conductive surface of a third substrate and a fourth connector disposed on the conductive surface of the third substrate proximate the first end of the second lighting module, the second lighting module being constructed and arranged to be disposed proximate a second T-bar section of the plurality of T-bar sections that intersects with the first T-bar section at the intersection region of the grid ceiling, the fourth connector being configured to electrically and mechanically connect to the second connector of the first connection module to transfer power to or from the first lighting module.

According to another embodiment, the first connection module includes four edges, wherein the second connector is disposed on the conductive surface of the second substrate proximate a first edge of the four edges, and wherein the first connection module further includes a fourth connector disposed on the conductive surface of the second substrate proximate a second edge of the four edges, the second edge being perpendicular to the first edge.

According to another embodiment, the first connection module includes four edges, wherein the second connector is disposed on the conductive surface of the second substrate proximate a first edge of the four edges, and wherein the first connection module further includes a third connector and a fourth connector, the third connector being disposed on the conductive surface of the second substrate proximate a second edge of the four edges, the fourth connector being disposed on the conductive surface of the second substrate proximate a third edge of the four edges, the first edge being perpendicular to the second edge and the third edge.

In accordance with some embodiments, the first lighting module includes a plurality of first lighting sub-modules sharing the first substrate, each first lighting sub-module of the plurality of first lighting modules including at least one low voltage light source electrically connected to the conductive surface of the first substrate, each of the plurality of first lighting sub-modules being electrically connected together via the conductive surface of the first substrate. According to a further embodiment, the first substrate includes at least one electrical isolation feature allowing a first lighting sub-module of the plurality of first lighting sub-modules to be electrically isolated from an adjacent first lighting sub-module of the plurality of first lighting sub-modules. According to a further embodiment, the first substrate further includes at least one separation feature allow the first lighting sub-module to be physically separated from the adjacent first lighting sub-module.

In accordance with at least one embodiment, the lighting system further comprises a first attachment member configured to secure the first lighting module proximate the first T-bar section. According to a further embodiment, the lighting system further comprises a second attachment member configured to secure the first connection module proximate the intersection region. According to a further embodiment, the at least one of the first and second attachment members includes one of a thermally conductive adhesive, double-sided adhesive thermally conducting tape, and a thermally conductive magnetic attachment member.

In certain embodiments, the lighting system further comprises a first diffuser constructed and arranged to cover the first lighting module and diffuse light emanating from the at least one low voltage light source. According to a further embodiment, the first diffuser has a hemispherical shape terminating in a first attachment clip and a second attachment clip, the first and second attachment clips being configured to secure the first diffuser to a horizontal section of the first T-bar section. According to a further embodiment, a length of the first diffuser and a length of the first lighting module are substantially the same. According to a further embodiment, the first diffuser includes at least one longitudinal ridge extending along the length of the first diffuser configured to secure the first lighting module in position proximate the first T-bar section. According to another embodiment, the first diffuser includes a plurality of longitudinal ridges extending along the length of the first diffuser configured to secure the first lighting module in registration with the first T-bar section.

In accordance with yet another embodiment, the lighting system further comprises a second diffuser constructed and arranged to cover the first interconnection module. According to a further embodiment, the second diffuser includes a plurality of attachment clips configured to secure the second diffuser to at least the first T-bar section. According to another embodiment, the second diffuser includes a plurality of attachment clips configured to secure the second diffuser to the first T-bar section and at least one other T-bar section of the plurality of T-bar sections interconnected at the intersection region of the grid ceiling. According to some embodiment, a portion of the second diffuser is constructed and arranged to overlap with a portion of the first diffuser.

In some embodiments, the lighting system further comprises a first diffuser, the first diffuser configured to secure the first lighting module in registration with the first T-bar section.

According to at least one embodiment, the first connector is one of a pin connector and a socket connector, and the second connector is the other of the pin connector and the socket connector. According to another embodiment, the first connector and the second connector are socket connectors, and wherein the lighting system further includes a plug connector to electrically and mechanically couple the first connector with the second connector.

In accordance with certain embodiments, the first connection module includes four edges, wherein the second connector is disposed on the conductive surface of the second substrate proximate a first edge of the four edges, and wherein the first connection module further includes a third connector disposed on the conductive surface of the second substrate proximate a second edge of the four edges, the second edge being one of perpendicular and parallel to the first edge.

According to another embodiment, the first connection module includes four edges, wherein the second connector is disposed on the conductive surface of the second substrate proximate a first edge of the four edges, and wherein the first connection module further includes a third connector and a fourth connector, the third connector being disposed on the conductive surface of the second substrate proximate a second edge of the four edges, the fourth connector being disposed on the conductive surface of the second substrate proximate a third edge of the four edges, the second edge being perpendicular to the first edge, and the third edge being parallel to the first edge.

According to yet another embodiment, the first connection module includes four edges, wherein the second connector is disposed on the conductive surface of the second substrate proximate a first edge of the four edges, and wherein the first connection module further includes a third connector, a fourth connector, and a fifth connector, the third connector being disposed on the conductive surface of the second substrate proximate a second edge of the four edges, the fourth connector being disposed on the conductive surface of the second substrate proximate a third edge of the four edges, and the fifth connector being disposed on the conductive surface of the second substrate proximate a fourth edge of the four edges, the second edge and the fourth edge each being perpendicular to the first edge, and the third edge being parallel to the first edge. According to a further embodiment, the second connector, the third connector, the fourth connector, and the fifth connector each includes a power conductor and a return conductor, the power conductor of the second connector being electrically connected to the power conductor of the third, fourth, and fifth connectors, and the return conductor of the second connector being electrically connected to the return conductor of the third, fourth, and fifth connectors. According to a further embodiment, the first connection module includes a first electrical isolation feature and a second electrical isolation feature, the first electrical isolation feature allowing the power conductor of the second and third connectors to be electrically isolated from the power conductor of the fourth and fifth connectors, and the second electrical isolation feature allowing the return conductor of the second and third connectors to be electrically isolated from the return conductor of the fourth and fifth connectors. According to another embodiment, the second, third, fourth, and fifth connectors are disposed on the second substrate in axial symmetry, so that a position of the second, third, fourth, and fifth connectors relative to the first connector is maintained as the second substrate of the first connector module is rotated by a multiple of ninety degrees about an axis perpendicular to a plane of the second substrate.

According to various embodiments, the first lighting module and the first connection module are constructed and arranged to be disposed on an exposed horizontal section of the first T-bar section and the intersection region of the grid ceiling, respectively.

In accordance with some embodiments, the lighting system further includes a power supply having an input and at least one output, the power supply being configured to receive electrical power having a first voltage level at the input, and to provide electrical power having a second voltage level to each at least one output, each at least one output being constructed and arranged to provide electrical power having the second voltage level to one of the first connector and the second connector. According to a further embodiment, the first voltage level is higher than the second voltage level. According to a further embodiment, the power having the first voltage level is AC power, and wherein the power having the second voltage level is DC power. According to another embodiment, the lighting system further comprises a controller to control the power supply. According to another aspect, the lighting system further comprises a controller to wirelessly control the power supply.

According to various embodiments, the at least one low voltage light source is a light emitting diode (LED).

In accordance with certain embodiments, the lighting system is Class 2 compliant.

In some embodiments, the substrate of the first lighting module is formed from a printed circuit board having a first conductive layer, a second conductive layer, and a dielectric layer separating the first conductive layer and the second conductive layer, the at least one low voltage light source and the first connector being disposed on the first conductive layer, wherein the second conductive layer is constructed and arranged to transfer heat generated from the at least one low voltage light source to the first T-bar section. According to a further embodiment, the second conductive layer is formed from a conductive material, wherein the conductive material covers substantially all of a surface of the first lighting module that is disposed proximate the first T-bar section. According to some embodiments, the conductive material covers at least 90% of the surface of the first lighting module that is disposed proximate the first T-bar section.

Still other aspects, embodiments, and advantages of these example aspects and embodiments, are discussed in detail below. Moreover, it is to be understood that both the foregoing information and the following detailed description are merely illustrative examples of various aspects and embodiments, and are intended to provide an overview or framework for understanding the nature and character of the claimed aspects and embodiments. Embodiments disclosed herein may be combined with other embodiments, and references to "an embodiment," "an example," "some embodiments," "some examples," "an alternate embodiment," "various embodiments," "one embodiment," "at least one embodiment," "this and other embodiments" or the like are not necessarily mutually exclusive and are intended to indicate that a particular feature, structure, or characteristic described may be included in at least one embodiment. The appearances of such terms herein are not necessarily all referring to the same embodiment.

BRIEF DESCRIPTION OF DRAWINGS

Various aspects of at least one embodiment are discussed below with reference to the accompanying figures, which are not intended to be drawn to scale. The figures are included to provide an illustration and a further understanding of the various aspects and embodiments, and are incorporated in and constitute a part of this specification, but are not intended as a definition of the limits of any particular embodiment. The drawings, together with the remainder of the specification, serve to explain principles and operations of the described and claimed aspects and embodiments. In the figures, each identical or nearly identical component that is illustrated in various figures is represented by a like numeral. For purposes of clarity, not every component may be labeled in every figure. In the figures:

DETAILED DESCRIPTION

Figure 1:
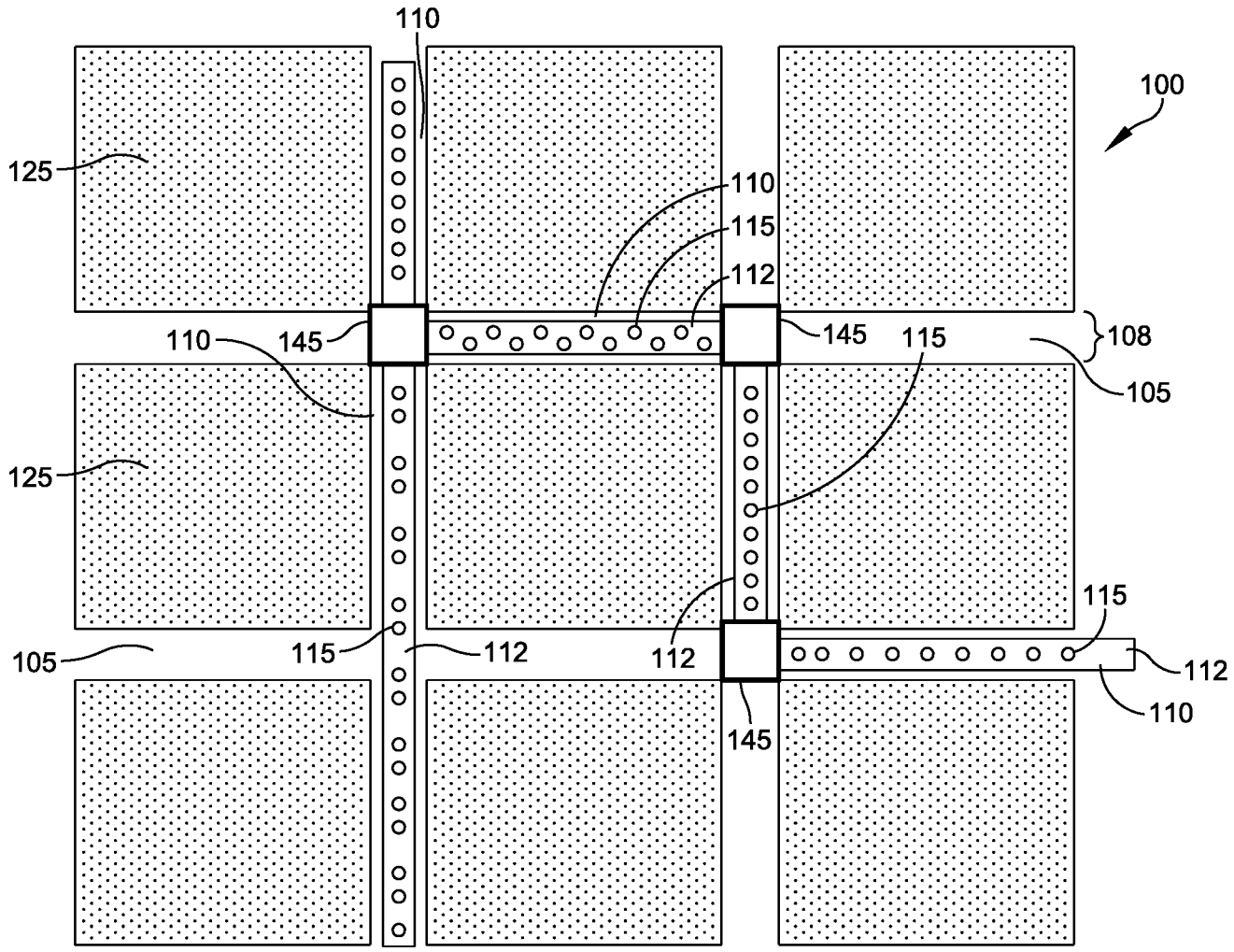
FIG. 1 is a generalized view from the illuminated space of a lighting system in accordance with one or more aspects of the disclosure.

By way of introduction, aspects of this disclosure relate to systems and methods of providing lightweight, low voltage fixtures, such as a low voltage lighting system that is configured to use in combination with a grid ceiling structure. The lighting systems disclosed herein are low voltage, or Class 2 compliant, and therefore offer a reduced risk of electrical shock and a reduced fire hazard. The lighting system is configured to attach to a T-bar of a grid ceiling structure and may include one or more light sources, such as LEDs. The lighting system is also extremely flexible with respect to different layouts and configurations. For example, the lighting system may be provided and configured into a variety of different lengths and shapes so as to provide a source of light for all or a portion of a room. Further, due to the grid ceiling structure and the size and type of the light source, heat produced by the lighting system may be dispersed through convection and radiation without having to resort to secondary or augmented means of heat removal.

The lighting system is simple to install, and because it is classified as low voltage, it does not require the services of a licensed electrician to perform the installation. For example, a homeowner may install the lighting system. Further, the system components are less expensive than other lighting options, such as troffer lighting fixtures. Other advantages include the fact that the lighting systems have few or no additional mechanical structures, which also reduces costs. Thus, the lighting systems disclosed herein offer a less expensive alternative than many other lighting installations. The assemblies are also lightweight, thereby minimizing potential handling risks. For example, because of their light weight, the lighting systems disclosed herein may be supported by the grid ceiling structure itself, without the need for independent support structures such as wires or cables.

The aspects disclosed herein in accordance with the present invention are not limited in their application to the details of construction and the arrangement of components set forth in the following description or illustrated in the accompanying drawings. These aspects are capable of assuming other embodiments and of being practiced or of being carried out in various ways. Examples of specific implementations are provided herein for illustrative purposes only and are not intended to be limiting. In particular, acts, components, elements, and features discussed in connection with any one or more embodiments are not intended to be excluded from a similar role in any other embodiments.

Also, the phraseology and terminology used herein is for the purpose of description and should not be regarded as limiting. Any references to examples, embodiments, components, elements or acts of the systems and methods herein referred to in the singular may also embrace embodiments including a plurality, and any references in plural to any embodiment, component, element or act herein may also embrace embodiments including only a singularity. References in the singular or plural form are not intended to limit the presently disclosed systems or methods, their components, acts, or elements. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms.

In accordance with one or more embodiments, a lighting system configured for use in a grid ceiling is shown in FIGS. 1-9A-9G, 11 and 12. According to some embodiments, the grid ceiling includes a plurality of T-bars 105, otherwise referred to herein as T-bar sections, which are interconnected at an intersection region of the grid ceiling. The lighting system is modular in that the layout can be tailored to a specific lighting application. According to one or more embodiments, the lighting system 100 includes at least one lighting module 110 and at least one connection module 145 that are each in electrical communication with a power supply 150. According to some embodiments, the power supply 150 may include a transformer 155. The lighting module 110 and the connection module 145 may each include attachment member 120, a conductive substrate 112, such as a printed circuit board (PCB), at least one light source 115, such as a low voltage light source, and optionally, a diffuser 135. In some embodiments, the diffuser may function as the mechanism for attaching the lighting module 110 and/or connection module 145 to the T-bar 105, as discussed in further detail below.

Common grid ceiling structures or systems, otherwise referred to as suspended ceiling systems, include evenly spaced suspension beams or support members that are suspended from the ceiling or other structural members of the building, and individual ceiling tiles of various sizes are suspended between adjacent support members. For example, referring to FIGS. 1-6, the grid ceiling system includes a plurality of inverted T-shaped members or T-bars 105, which may be of the type commonly used for a grid ceiling. The T-bars 105 are constructed from a sturdy lightweight material, such as aluminum or thin sheet steel, and are spaced at regular intervals in longitudinal and transverse directions to form a grid. For example, the T-bars 105 can be spaced to form 1-foot, 2-foot, 3-foot, or 4-foot intervals. The T-bars 105 are typically spaced at regular intervals to accommodate ceiling tiles 125 that are sized with lengths to accommodate the 1-foot, 2-foot, 3-foot, or 4-foot intervals created by the T-bars. For example, the width of the T-bar may be 1 inch and the width of the ceiling tile may be approximately 24 inches. The longitudinal and transverse sections of the T-bars 105 are configured to interlock to form a plurality of openings. The openings formed by the intersecting sections of T-bars 105 may be square or rectangular in shape, although other shapes are within the scope of this disclosure.

For example, a rectangular opening may be formed by a spaced interval of 2 feet in the longitudinal direction and a spaced interval of 4 feet in the transverse direction. The T-bars 105 may be provided in a variety of sizes and styles. For example, a common width 108 of the T-bar 105 is 15/16 of an inch, typically referred to as 1 inch. It should be appreciated that other sizes and standard dimensions are within the scope of this disclosure. For example, in locations where metric dimensions are used, the grid may be 600×600 mm, with ceiling tiles sized at 595×595 mm, or the grid may be 600×1200 mm, with ceiling tiles sized at 595×1195 mm.

Ceiling tiles 125 are positioned in the openings formed by the T-bars 105. Referring to FIGS. 3-6, the T-bar 105 includes a vertical section 106 and a horizontal section or flange 107. The upper surface of the horizontal section 107 is configured to provide support for the ceiling tiles 125. Access to the space above the ceiling is provided by lifting the tiles upward out of the grid. The bottom surface of the horizontal section 107 is configured to provide support for the lighting system, as discussed further below. The T-bar grid is generally supported by suspension rods or wires 130 which are connected to the vertical section 106 of the T-bars 105 and anchored into the ceiling or other supporting structure of the building.

Ceiling tiles 125 suitable for the purposes of this disclosure may be obtained from commercial sources available on the open market. For example, ceiling tiles 125 may be obtained in 2×2 foot or 2×4 foot dimensions and made from an insulating material such as fibrous foam and/or plastic composite materials. Other sizes of ceiling tiles in accordance with the present disclosure may also be suitable, and may include square or rectangular shapes of other dimensions. The ceiling tiles 125 may also be made from a wide variety of building materials and composites, such as polymer and/or foam composites, or any other lightweight building material. Although not depicted in FIG. 1, the ceiling tiles may include beveled edges.

Referring now to FIG. 1, a bottom view of a lighting system configured for use in a grid ceiling structure and generally indicated at 100, illustrates at least some of the versatility of the systems and methods disclosed herein. A grid ceiling structure with ceiling tiles 125 and T-bars 105 is provided as discussed above. At the intersection of a longitudinal and transverse T-bar 105 is a connection module 145, discussed in further detail below. Although not shown in FIG. 1, the lighting module 110 and the connection module 145 attach to the T-bars 105 through the use of attachment member 120. In at least one embodiment, the attachment member 120 attaches a top surface of the connection module 145 and/or the lighting module 110 to the bottom surface of the T-bar 105. The attachment member 120 may be sized to fit within the width 108 of the T-bar 105. For example, if the width 108 of the T-bar is 15/16 of an inch, then the width of the attachment member 120 may be ¾ of an inch. As noted earlier, it should be appreciated that embodiments of the present invention may readily be adapted to the typical dimensions of grid ceilings used in other countries outside of the U.S. According to at least one embodiment, the attachment member 120 may be an adhesive material, such as a double-sided thermally conductive adhesive material that is heat resistant. The attachment member 120 may be magnetic tape or strips, epoxy, or other cement or adhesive that may be applied to one or both mating surfaces depending on the type of surface and the specific application for the lighting system. Other types of devices or materials suitable for functioning as an attachment member 120 are also with the scope of this disclosure. For example, the attachment member 120 may take the form of one or more clips or mechanical fasteners, such as hook and loop fasteners, bolts, screws, washers, snaps etc., one or more of which (e.g., clips or the diffuser itself, as discussed below) may secure the top surface of the lighting module 110 or the connection module 145 proximate to the bottom surface of the T-bar 105 without direct attachment. According to other embodiments, the attachment member 120 may be magnetic, such that the lighting module 110 and the connection module 145 are held to the T-bar 105 using magnetic forces.

FIG. 1 illustrates one possible configuration of a lighting system that includes multiple lighting modules 110 and connection modules 145. The lighting modules 110 are positioned along the length of the T-bars 105, and the connection modules 145 are positioned at the intersection of longitudinal and transverse T-bars 105. For instance, the lighting module 110 may be constructed and arranged to be disposed on an exposed horizontal section of a T-bar 105, and the connection module 145 may be constructed and arranged to be disposed on the intersection region of the grid ceiling. Each lighting module 110 includes one or more light sources 115, which may be arranged in various arrays that are attached to a conductive substrate (otherwise referred to herein as simply "substrate") 112 in any desired configuration. As used herein, the term "conductive substrate" refers to a substrate comprising a conductive material or conductive surface capable of transferring electrical current. Thus, one or more components, such as a connector 160 (discussed below), a light source 115, or any other electrical component may be disposed on the conductive surface of the substrate. The conductive substrate 112 may be made from electrically conductive material or may be obtained from coating, depositing, or laminating an electrically conductive layer on one or more surfaces of an insulating material. One example of a conductive substrate suitable for the lighting systems disclosed herein includes a printed circuit board (PCB). According to some embodiments, the conductive substrate 112 is rigid, although in other embodiments, the conductive substrate 112 may be flexible, as discussed further below.

According to some embodiments, power in the form of electrical current is supplied to the connection modules 145 and to the lighting modules 110 through a power supply 150 (not shown in FIG. 1), which can be positioned in the building's structural ceiling or other structure. Although not shown in FIG. 1, the lighting system 100 may further include one or more diffusers 135 that are positioned over one or more of the light sources 115 positioned on the lighting module 110 and the connection module 145, as discussed further below. According to some embodiments, the diffuser 135 may function as the form of attachment of the lighting module 110 and/or connection module 145 to the T-bar 105.

According to some embodiments, at least one end of each lighting module 110 is mechanically and electrically attached to a connection module 145. In accordance with certain embodiments, the lighting module 110 may be mechanically and electrically attached to a connection module 145 and/or another lighting module 110 using a connector 160, as discussed in further detail below in reference to FIGS. 7A-7C, 8, and 11. For example, the lighting module 110 may fasten or otherwise attach to the connection module 145 through one or more conducting pins, i.e., an interconnection device 165 as discussed further below, positioned on the edge of the lighting module 110 that fit into a pin receptacle (also referred to herein as a socket connector), i.e., a connector 160 as discussed further below, positioned on the connection module 145. Specific examples of a lighting module 110 and a connection module 145 are illustrated in FIGS. 7A-7C and FIG. 8, respectively. Although not shown in FIG. 1, the connection module 145 may also include various arrays of light sources 115 attached to the conductive substrate 112, as discussed below in reference to FIG. 2.

Figure 7A:
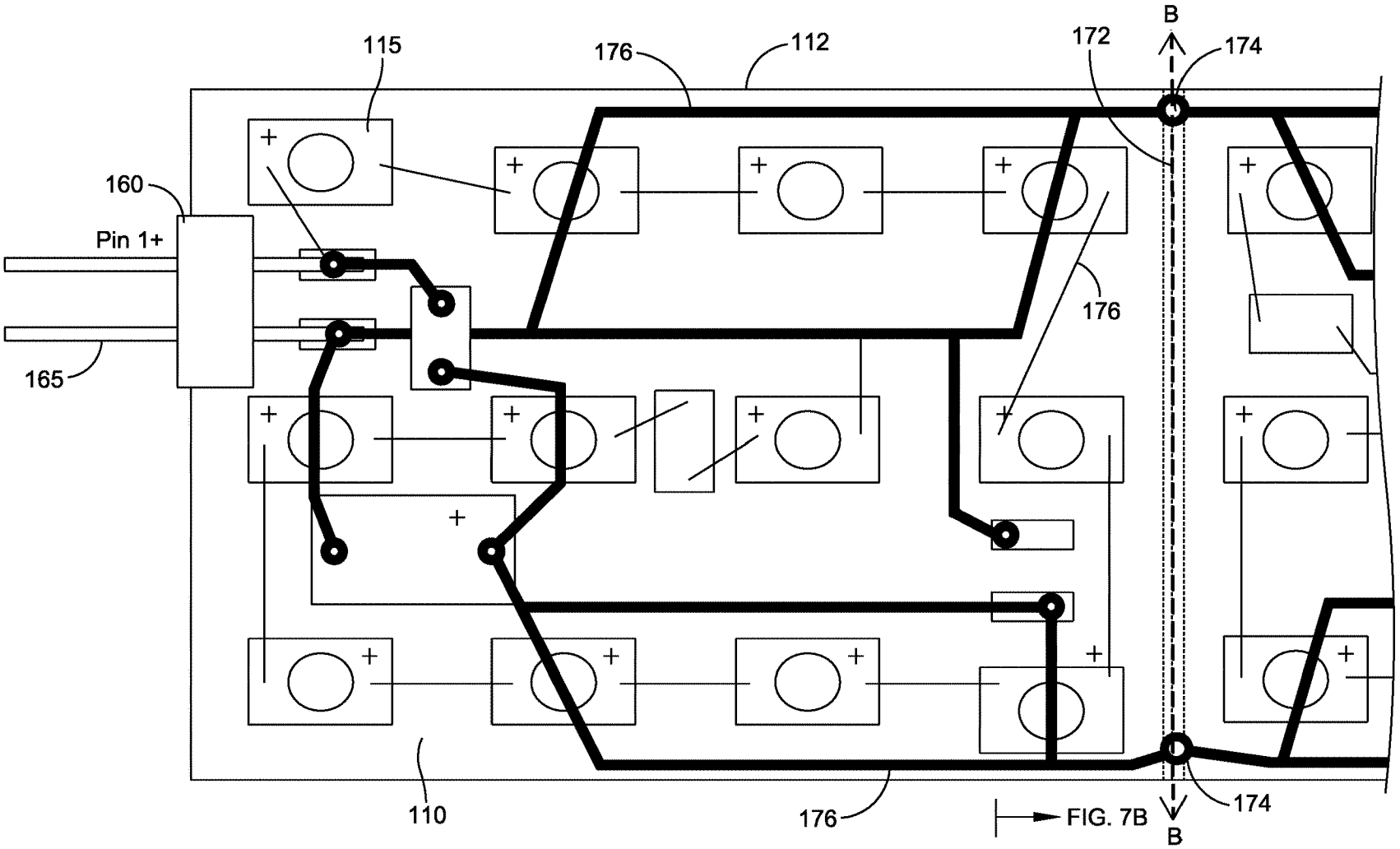
FIG. 7A is a top view of a first portion of a lighting module in accordance with one or more aspects of the disclosure.
Figure 7B:
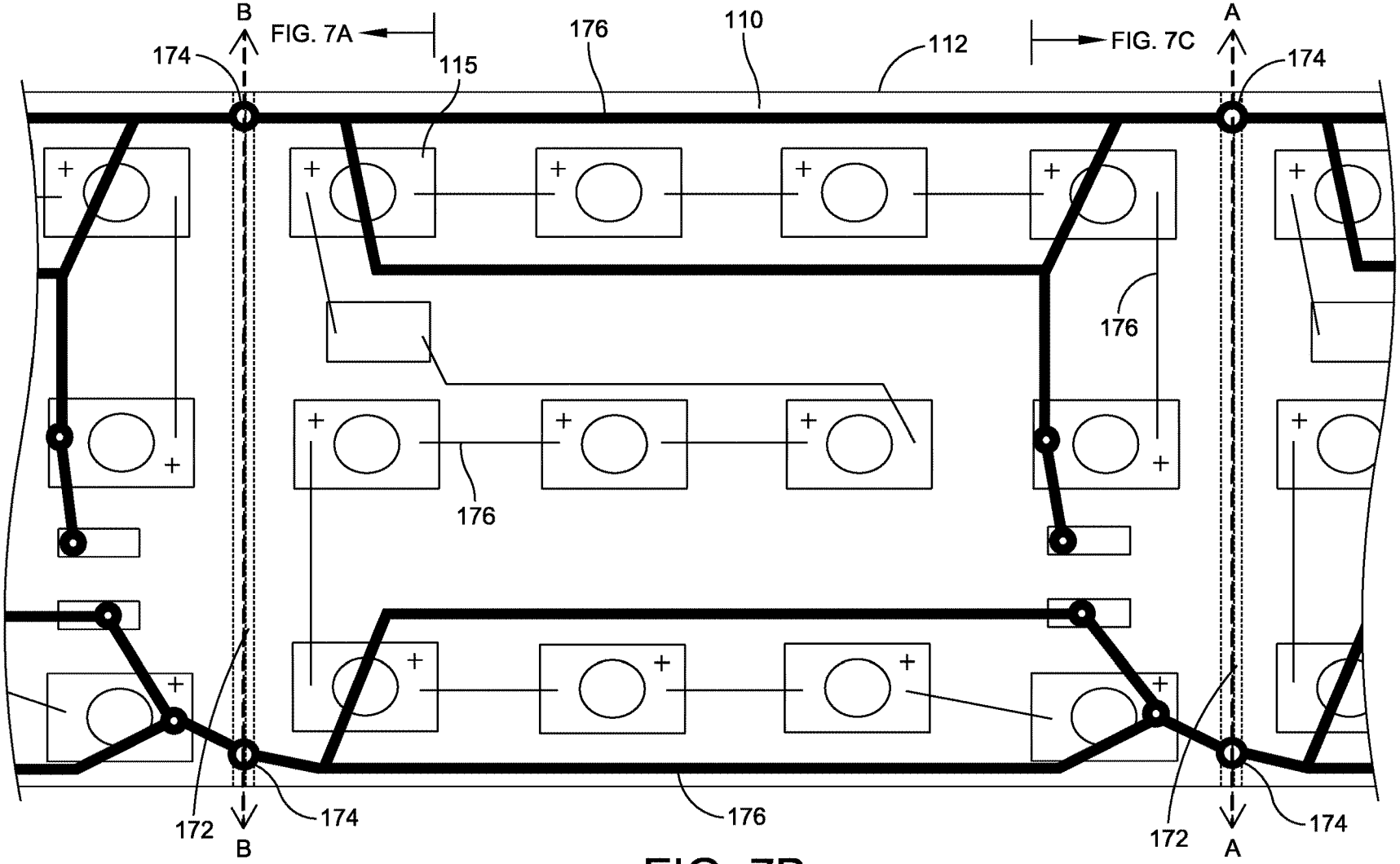
FIG. 7B is a top view of a second portion of a lighting module located adjacent to the first portion of lighting module of FIG. 7A in accordance with one or more aspects of the disclosure.
Figure 7C:
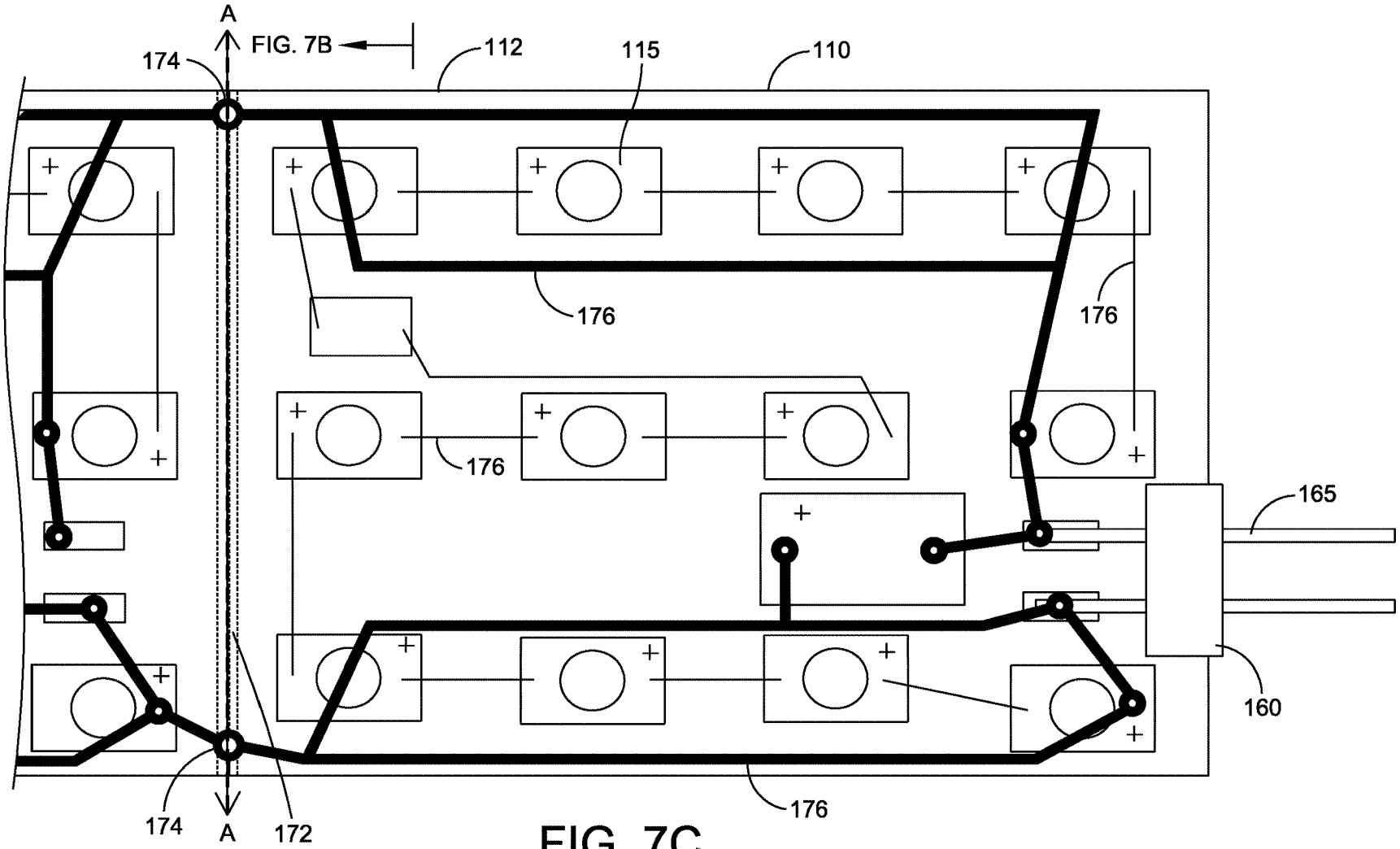
FIG. 7C is a top view of a third portion of a lighting module located adjacent to the second portion of the lighting module of FIG. 7B in accordance with one or more aspects of the disclosure.

Referring to FIGS. 7A-7C, three portions (left, center, and right) of a lighting module 110 in accordance with at least one embodiment are shown such that FIGS. 7A-7C laid out end-to-end show a full lighting module. All or a portion of the lighting module 110 may be disposed proximate a T-bar section 105. FIG. 7A is a top view of a first portion of a lighting module 110. As shown, the lighting module includes a plurality of light sources 115, which in this instance are LEDs arranged in a 4×3 array. It should be appreciated that the arrangement of LEDs may vary. For instance, the lighting module may include one light source 115 or a plurality of light sources arranged in an array or any other desired configuration. In accordance with one embodiment, the lighting module 110 may include a plurality of sub-modules that share a common conductive substrate 112. Each of the sub-modules may include at least one low voltage light source 115 that is electrically connected to the common conductive substrate 112. Further, each sub-module of the plurality of sub-modules may be electrically connected together via the common conductive substrate 112. This configuration may allow for several groups or arrays of LEDs to be arranged along the length of the lighting module, as shown in the lower portion of FIG. 9A. These groups or arrays of LEDs may be electrically isolated from each other through the use of an electrical isolation feature 174 such as a drill pad, as discussed in further detail below, which allows a sub-module to be electrically isolated from an adjacent sub-module. Further, a separation feature 172 such as a scribe line, may be provided to the common conductive substrate 112 of the first sub-module to be physically separated from the adjacent sub-module. For instance, FIG. 7A features a first sub-module, FIG. 7B features a second sub-module, and FIG. 7C, features a third sub-module, where each sub-module may be electrically isolated from one or more of the other sub-modules through the use of the electrical isolation feature 172 and physically separated from one or more of the other sub-modules through the use of the separation feature 174. As shown in FIGS. 7A-7C, the separation feature 172 may intersect the electrical isolation feature 174.

An optional diffuser 135, as discussed further below in reference to FIGS. 10A-10J, may also be fitted to all or at least a portion of the lighting module 110 shown in FIGS. 7A-7C. The diffuser 135 may be constructed and arranged to diffuse light emanating from at least one light source 115. The diffuser may be configured to cover at least one light source 115, and depending on the application, the diffuser 135 may be optically transparent, diffusive, or tinted. At least one end of the lighting module 110 includes a connector 160 that mechanically and electrically attaches to the conductive substrate 112. For example, the connector 160 may be disposed proximate a first end of a lighting module 110 and may include one or more contacts that are soldered to a PC board (conductive substrate) trace. The connector 160 of the first lighting module 110 is also configured to electrically couple to another module, such as a connection module 145 or a second separate lighting module 110. The other module may also include a connector 160 that is configured to electrically and mechanically couple to the first connector to transfer electrical current to or from the first lighting module 110. Thus, the connector 160 may be configured to transfer electrical current from the power supply 150 through the conductive substrate 112 to each light source 115. This may be accomplished by transferring electrical current through an interconnection device 165, which is in electrical communication with the connection device 160. For example, the embodiment of FIG. 7A features a connection device 160 that is a socket connector and an interconnection device 165 that is a pair of conducting pins, i.e., a pin connector. The connector 160 may therefore be a socket connector and the interconnection device may be a pin connector, although it will be appreciated that other types of connectors and interconnection devices are within the scope of this disclosure. Electrical current either comes in directly from the power source 150 or transfers from another module to one end of the lighting module 110 through the interconnection device 165 and then to the connector 160, the conductive substrate 112, and then to the light sources 115. Electrical current also transfers through the conductive substrate 112 to the connector 160 and the interconnection device 165 positioned at the other end of the lighting module 110, where it either terminates or transfers out to another module. FIGS. 7A-7C also include an example of a connective pathway 176 that indicates the electrical connection path, i.e., circuit traces, such as the printed circuit board traces, for current flow that is integrated into the conductive substrate 112. For example, the connective pathway(s) 176 shown in FIGS. 7A-7C indicate the copper conductive path that is formed in a PCB board. As shown, copper that forms the connective pathway 176 may be of varying widths, for example to reduce power loss or reduce material costs. As shown, connective pathway 176 may have a greater width, to minimize power loss, than the individual traces electrically connecting one light source 115 to another. The connective pathway 176 may be altered or modified through the use of a separation feature 172, such as a scribe line, and/or one or more electrical isolation features 174, such as a drill pad, which are disposed at various positions along one or more connective pathways 176 that demark where, for example, one circuit can be physically and electrically severed and split into two or more electrical circuits. For example, the separation feature 172, which in FIG. 7A is a scribe line marked as "B-B" also includes two electrical isolation features 174, which in FIG. 7A are drill pads. Other types of separation features and electrical isolation features are also within the scope of this disclosure. For instance, instead of a drill pad, the electrical isolation feature may be a removable jumper, as understood by one skilled in the art. The separation feature 172 may be any feature that permits the conductive substrate to be physically separated into separate pieces. The connective pathway 176 can therefore be terminated by drilling out the two drill pads and then snapping off the first portion of the lighting module along the separation feature 172, such as the scribe line shown in FIGS. 7A-7C. Electrical current is thereby prevented from transferring to the second portion of the lighting module 110, which is shown in FIG. 7B and is positioned immediately adjacent to the first portion of the lighting module 110 shown in FIG. 7A. FIG. 7B also includes a 4×3 array of light sources 115 and includes a separation feature 172, which in this embodiment is also a scribe line marked as A-A, and two electrical isolation features 174, which in this instance are also drill pads. As in FIG. 7A, the drill pads and scribe line indicate where one or more of the connective pathways 176 can be terminated and where one circuit may be split into physically separate circuits. Thus, the second (middle) portion of the lighting module 110 can either be included with the first portion of the lighting module shown in FIG. 7A, or can be included with the third portion of the lighting module 110 shown in FIG. 7C. FIG. 7C is top view of a third portion of a lighting module 110 that is positioned immediately adjacent to the second portion of the lighting module shown in FIG. 7B and shows the second end of the lighting module 110. FIG. 7C also includes a 4×3 array of light sources and, like the first end, includes a connector 160 and an interconnection device 165, which in this embodiment is a socket connector and a pin connector, respectively. As discussed above, electrical current either transfers into the conductive substrate 112 and flows through the connective path 176 (and to the light sources 115) through the connector 160 and interconnection device 165 positioned on the first end of the lighting module 110 shown in FIG. 7A, or through the second end of the lighting module 110 shown in FIG. 7C.

Figure 8:
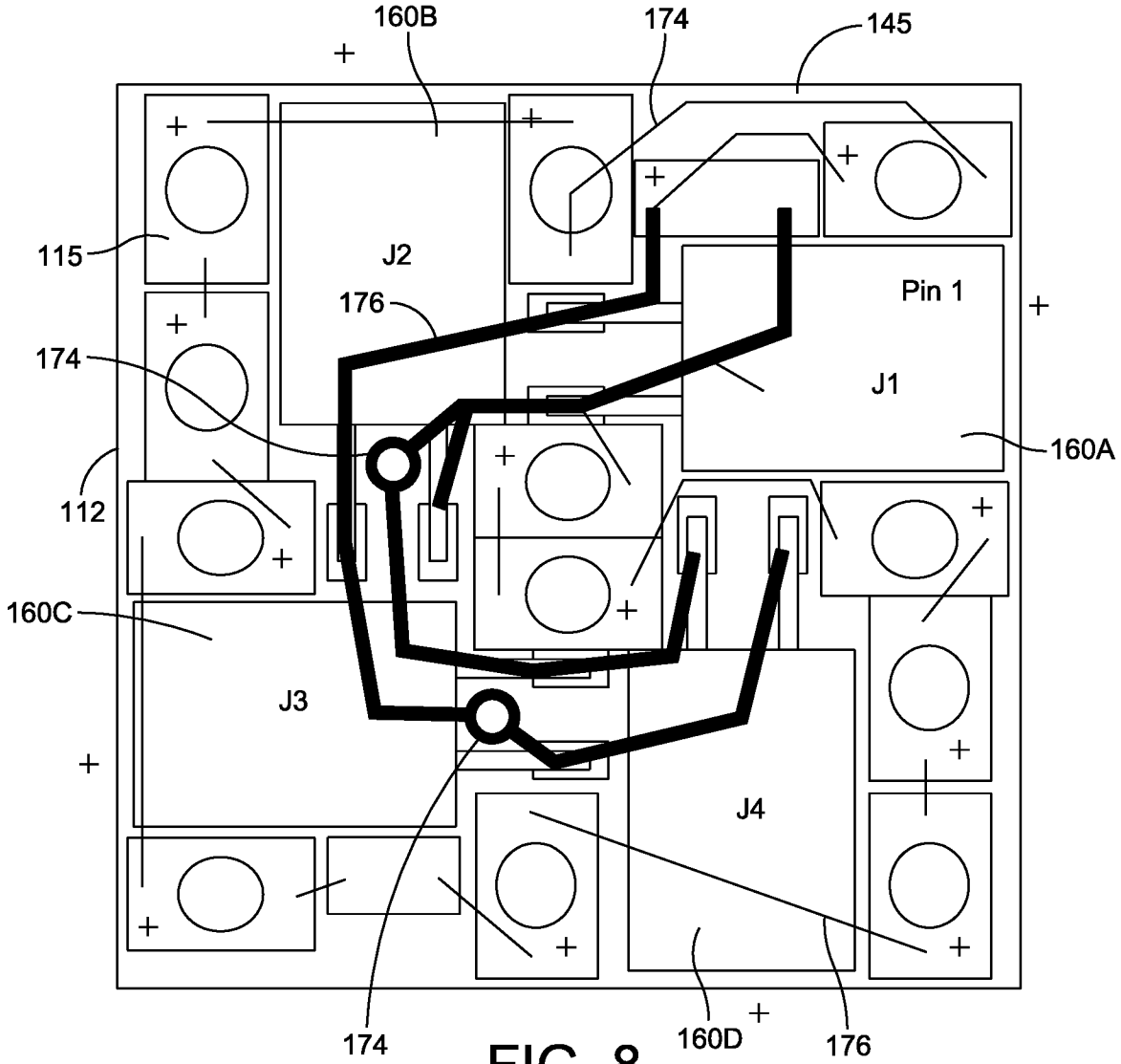
FIG. 8 is a top view of a connection module in accordance with one or more aspects of the disclosure.

Referring to FIG. 8, a top view of a connection module 145 that is in accordance with one or more embodiments is shown. The connection module 145 has a conductive substrate 112 and one or more light sources 115 as described above. According to at least one embodiment, the connection module 145 is constructed and arranged to be disposed proximate the intersection region of the grid ceiling. For example, the connection module 145 may be positioned at the intersection of two or more intersecting T-bars 105. The connection module 145 also includes at least one connector 160, which may be a socket connector that transfers electrical current from the power supply 150 to the conductive substrate 112 and the light sources 115. For example, one or more of the connectors 160 disposed on the connection module 145 may be a commercially available BG300 series device. The embodiment of the connection module 145 shown in FIG. 8 includes four connectors 160, each of which may be electrically and mechanically coupled to a connector on each of four separate lighting modules 110 (one positioned on each edge). Although not shown in FIG. 8, the interconnection device 165, such as the pin connector shown in FIGS. 7A-7C, may be inserted into the connection device 160 of the connection module 145, which in FIG. 8 is a socket connector. As shown, the connection module 145 of FIG. 8 includes four connectors, one on each edge of the conductive substrate 112, indicating that the connection module 145 may be connected to up to four different lighting modules 110, such as the lighting module shown in FIGS. 7A-7C. For instance, a first connector may be disposed on one edge of the conductive substrate 112 of the connection module 145 and a second connector may be disposed on an edge of the conductive substrate 112 that is perpendicular to the edge of the conductive substrate 112 on which the first connector is disposed. Likewise, a third connector may be disposed on an edge of the conductive substrate 112 that is perpendicular to the edge of the consecutive substrate 112 on which the first connector is disposed and opposite the edge of the conductive substrate 112 on which the second connector is disposed. A fourth connector may also be disposed on an edge of the conductive substrate 112 that is opposite to the edge of the conductive substrate 112 on which the first connector is disposed.

The connection module 145 of FIG. 8 also includes a connective pathway 176 that includes at least one electrical isolation feature 174 that can be used to create one or more electrical circuits. For example, the electrical isolation feature 174 shown in FIG. 8 includes two drill pads that can be selectively drilled out to create different circuitry. For instance, drilling out both drill pads in FIG. 8 allows for two independent circuits to be created on the connection module 145, such that the connectors labeled 160A and 160B are electrically separate from the connectors labeled 160C and 160D. In addition, according to one embodiment, the connection module 145 may include a plurality of low voltage light sources 115 that are electrically connected to the common conductive substrate 112. As shown, each of the low voltage sources 115 are electrically connected to one another. These groups or arrays of LEDs may be electrically isolated from each other through the use of an electrical isolation feature 174 such as a drill pad that allows a sub-module to be electrically isolated from an adjacent sub-module.

As shown, the connection module 145 in FIG. 8 includes at least one light source 115. As discussed above in reference to the lighting module 110, the connection module 145 may include one or more light sources 115 that are arranged in an array or in any pattern, random or otherwise, that is desired for a particular application. An optional diffuser 135 (not shown in FIG. 8), such as one or more of the diffusers discussed further below in reference to FIGS. 10A-10J, may also be fitted to the connection module 145 and may be configured to cover at least one light source 115. Depending on the application, the diffuser 135 may be optically transparent, diffusive, or tinted.

Referring back to FIG. 1, the placement of the lighting modules 110 and the connection modules 145 on the T-bars 105 can be accomplished using an endless variety of different configurations, with restriction presented only by the voltage and/or power threshold if the application is to be classified as a Class 2 installation. As previously mentioned, according to one or more embodiments the lighting system 100 is configured to be low voltage. As used herein, the term "low voltage" refers to a power density that falls within the National Electric Code (NEC) standards Class 2 circuits. Therefore, one or more embodiments of the lighting systems disclosed herein meet the Class 2 requirements as defined in UL 1310 Class 2 Power Units and NEC Article 725 for Class 2 Power Limited Circuits. For example, a Class 1 limited power source circuit is limited to 30 volts and 1,000 volt-amperes (VA) and a Class 2 limited power source circuit is limited to 30 volts, 100 VA, and 8 amperes. For example, according to some embodiments, the power density does not exceed 4 W/ft. In general, a Class 2 circuit operates at 60 Volts DC or less and does not exceed 100 VA. For example, one or more of the lighting systems disclosed herein may be configured to provide 400 lumens/ft, or about 37 milliwatts/LED. In certain instances, this equates to 9 low power model 3528 LED's per inch of length of the lighting module 110 and/or connection module 145. Class 2 circuits may reduce the risk of electrical fires by limiting the power used in the circuit. For example, the power may be limited to 100 VA, or in some instances, 60 VA for an individual circuit that operates at 30V or less. Class 2 circuits may also provide reasonable protection from electrical shock by limiting the current of the circuit. For example, the current may be limited to 5 mA or less for circuits between 30 V and 150 V. Class 2 systems do not require the same wiring methods as Class 1 power and lighting systems. At least one advantage of a Class 2 wiring installation is that it is not required to be installed by a licensed electrician, which reduces the cost and complexity of a particular installation. Further, as mentioned above, Class 2 installations also reasonably reduce the risk of electrical shock and fire. According to one or more embodiments, the lighting systems disclosed herein operate at 38 volts DC and are supplied up to 2.6 amperes of current per electrically isolated array of lights. It will be appreciated that the lighting systems disclosed herein may be adapted for use with all NEMA (National Electrical Manufacturers Association) standards as well as all other international electrical standards seen outside of the United States.

Figure 12:
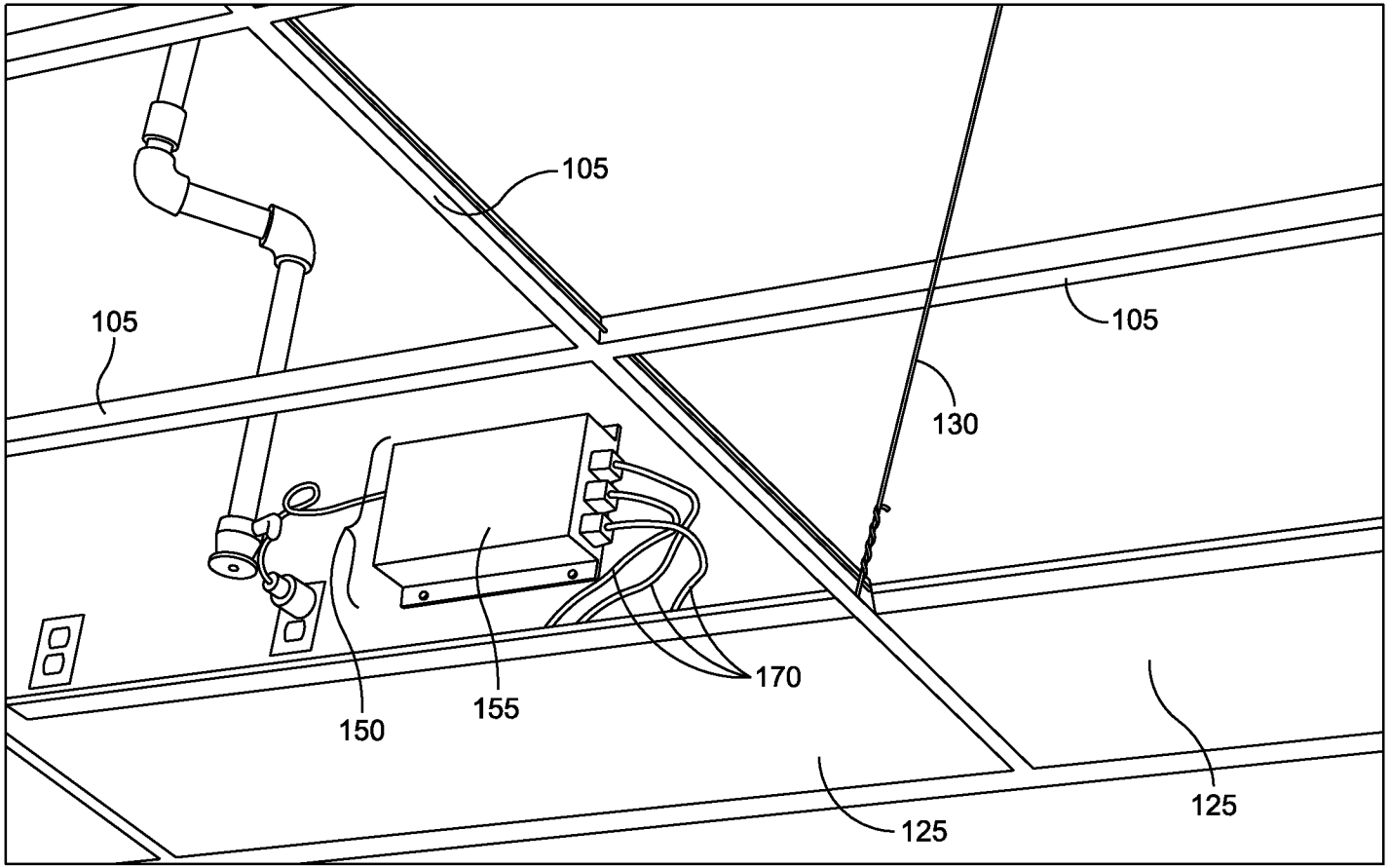
FIG. 12 illustrates several power subcomponents of a lighting system in accordance with one or more aspects of the disclosure.

According to some embodiments, the power supply 150 includes an input and at least one output. In some embodiments, the power supply 150 is configured to receive electrical power having a first voltage level at the input and to provide electrical power having a second voltage level to each output, where each output is constructed and arranged to provide electrical power having the second voltage to a lighting module 110 and/or a connection module 145, via a connector 160. In certain embodiments, the first voltage level is higher than the second voltage level. In some embodiments, the first voltage level is AC power and the second voltage level is DC power. For example, the power supply may include a transformer 155. An example of this arrangement is shown in FIG. 12. For instance, in some embodiments, low voltage electrical applications use a transformer to step the 120 VAC line voltage down to 60 VDC or less. The power supply 150 typically includes a 3-prong plug to connect to a grounded AC receptacle, and one or more connectors to connect to a respective conductive wire 170, which in certain instances may be a cable, to provide DC power to a lighting module 110 or connection module 145. The power supply 150 may include one or more connectors to supply power to a respective lighting system 100. For example, in the embodiment shown in FIG. 12, the power supply 150 includes three connectors, each configured to provide power to a respective lighting system via a respective conductive wire or cable 170. It should be appreciated that in larger installations, a number of such power supplies may be needed, and that the number of connectors provided on a particular power supply may vary according to the number of lighting systems for which power is to be provided. Depending on the application, the type of transformer may be classified as magnetic or electronic. The power supply 150 may be positioned remotely and suspended from or affixed to the ceiling, wall, other supporting structure of the building and in electrical communication with the lighting system 100, for example, through integration with the power supply 150, as shown in FIG. 12.

The lighting modules 110 may be arranged in a multitude of lengths and lighting configurations. As discussed above, the lighting modules 110 may be sized to accommodate and fit to the dimensions of any standard grid or ceiling system, and may also be customized to fit non-standard dimensions as well. For example, the lighting module 110 may be provided in sections that correspond to dimensions of the grid ceiling, such as 2-foot and/or 4-foot sections. For example, FIGS. 7A-7C include a single lighting module 110 with a total length of 23 inches and a width of 1 inch. According to another embodiment, each section of the lighting module may have a total length of 24 inches and a width of 1 inch, or a total length of 12 inches and a width of 1 inch, such as the lighting module 110 discussed below in reference to FIG. 11 which features a lighting module with a continuous or common substrate that includes a connection module at one end. Further, each of the lighting module 110 and the connection module may include one or more LEDs. For example, a lighting module that is 23 inches in length may support up 216 LEDs, and a connection module that is one inch square may support up to 12 LEDs. For example, a 23-inch long lighting module 110 may be connected to a 1 inch square connection module 145 using a pin and socket assembly, as shown in FIGS. 7A-7C and 8. In another example, the 23-inch long lighting module 110 may be co-joined with the 1 inch square connection module without the use of a pin and receptacle, i.e., the two modules may be fabricated as one structure, as discussed further below in reference to FIG. 11. Further, as discussed above and as shown in FIGS. 7A-7C, each end of the lighting module 110 includes a connector 160 and an interconnection device 165, such as a pair of pins that are configured to mate with a connector 160, such as a socket connector, located on a connection module. In other embodiments, the interconnection device 165, including the pin connector on either end of the lighting module shown in FIGS. 7A-7C may mate with a socket connector positioned on the end of another lighting module, thereby creating a side-by-side arrangement arranged lengthwise. As described above in reference to FIGS. 7A-7C, in some embodiments the lighting module is fabricated to be divided into sections. For example, lines A-A and B-B demarcate separation features 172, which in this instance are score lines, and electrical isolation features 176, such as drill pads, where separate electrical circuits can be created on the lighting module.

Figure 2:
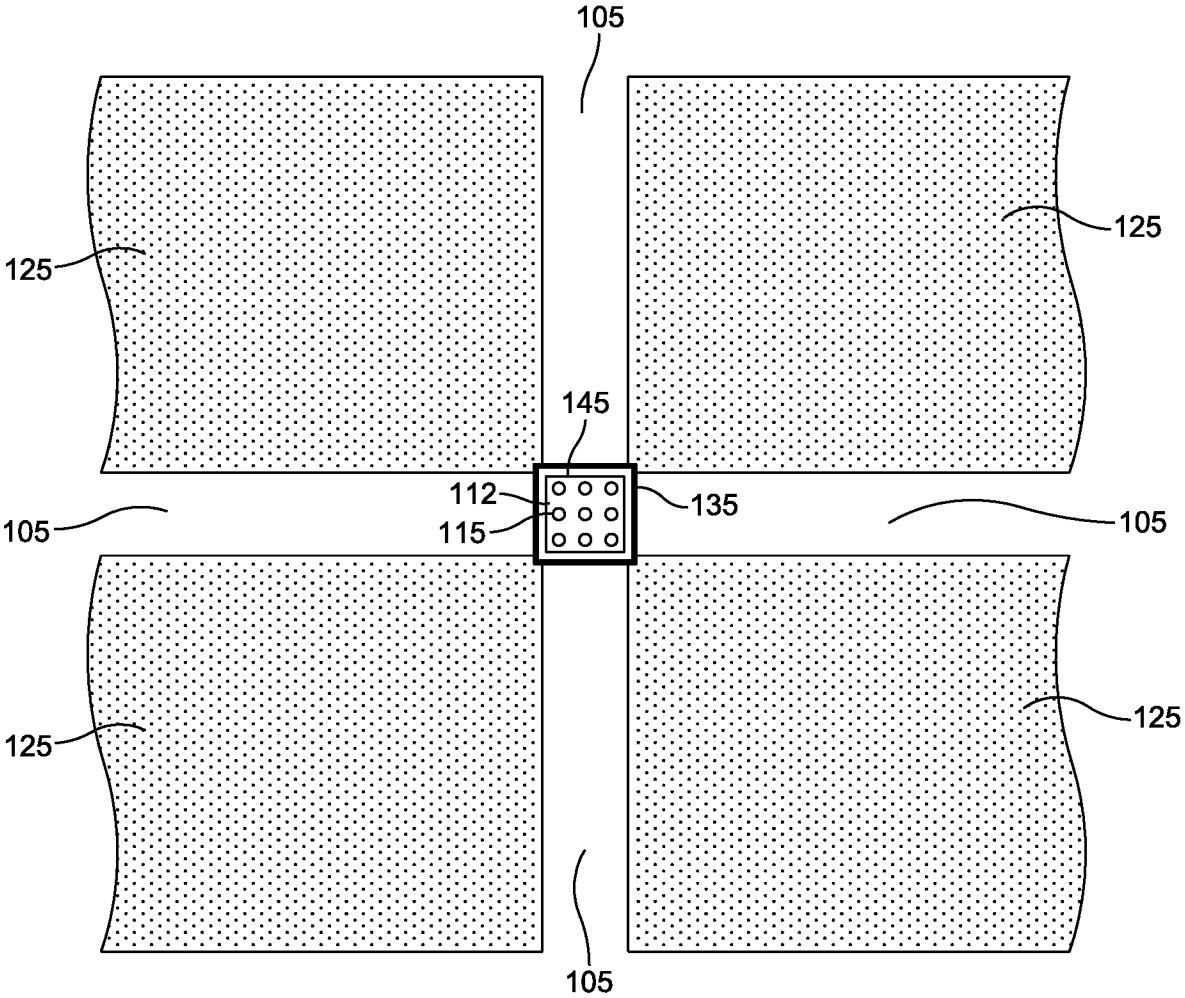
FIG. 2 is a generalized view from the illuminated space of another lighting system in accordance with one or more aspects of the disclosure.

Referring now to FIG. 2, a bottom view of a connection module 145 is shown that is positioned at the intersection of longitudinally and transversely oriented T-bars 105. Four ceiling tiles 125 are also positioned at the openings formed by the grid ceiling structure. The connection module 145 includes a square-shaped conductive substrate 112 and at least one light source 115. According to at least one embodiment, the at least one light source 115 may include an array of LEDs, such as the arrays shown above in reference to FIGS. 7A-7C. According to some embodiments, the connection module 145 may be sized to fit within a region defined by the intersecting T-bars 105. For example, the connection module 145 may be a 1×1 inch square. In other examples, the connection module 145 is sized to fit within the dimensions of an existing T-bar 105. For example, if the T-bar 105 is one inch in width, i.e., the horizontal section of the T-bar 107, the connection module 145 may be dimensioned to be slightly smaller than 1 inch. In other embodiments, the connection module may be sized to be the same dimension as the width of the T-bar 105. The connection module 145 is attached to the T-bars 105 using the attachment member 120, as described above. A diffuser 135, discussed in further detail below in reference to FIGS. 10A-10J, may also be attached to the lighting module 110 and/or connection module 145, as shown in FIGS. 3-6. The diffuser 135 is configured to at least partially cover the light source 115 and in certain instances, may also be configured to attach to the intersection of the T-bars 105 using four L-shaped clips that are positioned at each corner of the diffuser 135. Although not shown, lighting modules 110 may be positioned on one or more of the four edges of the connection module 145. For example, as discussed above in reference to FIG. 8, the connection module 145 may include four connectors 160, such as socket connectors, with each socket connector positioned on each edge of the connection module 145. As discussed above, the socket connector is configured to mate with a pin connector on the lighting module 110. The connection module 145 also includes at least one electrical isolation feature 174, such as a drill-out pad, also referred to as simply a "drill pad" that is positioned on the connection module to allow for flexibility in forming independent electrical circuitry. For example, two independent circuits may be created by drilling out the drill-out pads shown in FIG. 8. The electrical isolation feature 174 allows for manipulation of the transfer of electric current to one or more of the lighting modules, thus allowing for flexibility in the layout of a lighting system. The lighting system may thus include one or more electrically isolated Class 2 circuits that include lighting modules 110 and connection modules 145 that are connected mechanically in a continuous manner. For example, a room may include several individual Class 2 circuits, where each Class 2 circuit is limited to 100 VA and includes lighting modules 110 and connection modules 145. The lighting modules 110 and connection modules 145 associated with one circuit may further be mechanically linked to a second circuit and/or a third circuit etc. This is made possible, in part, by the design of the modules, such as the electrical isolation feature.

According to at least one embodiment, electrical current is transferred from the power supply 150 to the connection module 145, where it is then transferred to the lighting module(s) 110 or vice versa to lighting module 110 and then to connection module 145. The connectors 160 and interconnection device 165, such as the pin and socket connectors discussed above, allow for the transfer of electrical current to and/or from the connection module 145 to the lighting module 110.

According to at least one embodiment, each of the lighting modules 110 and the connection modules 145 are configured to be symmetrical, i.e., axial symmetry, meaning that they are not restricted in their geometrical orientation. For example, in some embodiments, the connection module 145 may be rotated 90 degrees and still accommodate four lighting modules 110. In addition, according to some embodiments, the lighting module 110 may be rotated 180 degrees and still connect to the connection module 145. According to at least one embodiment, the connection module 145 may include fewer than four connectors 160. For instance, the connection module 145 may only include two connectors 160, such as the connectors marked as 160B and 160D in FIG. 8, for straight unbranched arrangement of modules, or may include the connectors marked as 160B and 160C in FIG. 8 for a corner (apex) arrangement of modules. These arrangements save costs on two connectors, but also reduce the flexibility of the module.

The lighting system may be configured to illuminate a particular portion of a room, such as by providing task lighting. The lighting system may also be configured to accommodate existing light structures, such as troffers containing other forms of lighting placed into the grid openings. Endless arrangements of the connection modules 145 and lighting modules 110 are possible, with the only restriction being that the power and voltage thresholds may not be breeched if the lighting system is to be Class 2 compliant. For example, in some examples, no more than 100 VA of available power is available to each independent circuit of the lighting system. As discussed above, multiple circuits that each includes one or more lighting and connection modules may be used in a single installation, such as a room. Further, according to some embodiments, the lighting modules 110 and connection modules 145 can be configured to form rings and/or branches.

Referring now to FIGS. 9A-9G, additional layouts and configurations of the lighting modules are shown that are included within the scope of this disclosure. For purposes of explanation, the embodiments are described using the terms: section 178, string 180, and array 182, which highlight the multitude of different geometric and electrical layouts that are within the scope of this disclosure. For example, a section 178 consists of one lighting module such as the lighting module discussed below in reference to FIG. 11, which may be 24 inches in length that includes one or more light sources 115. Each light source 115 may be an LED that connects to another LED in series, or in a series-parallel configuration, and according to some embodiments, may be laid out in a repeating pattern on the section 178 (see bottom portion of FIG. 9A). A string 180 includes one or more sections 178 that are electrically connected in series without branching and may be described as having a length of L, which may be in units of feet. The individual sections 178 may be connected to each other using a connector 160 and interconnection device 165 as described herein. The total individual light source PC board trace loop resistance, i.e., the resistance measured at one end of the connector with the far end connector shorted, may be represented as $R_0$ ohms per foot distributed uniformly over the PC board length. The total string resistance may be defined as $R_s=L\times R_0$, which assumes that the external wiring is of zero resistance. The voltage drop over all light sources in a section may be represented by $V_w$. An array 182 includes one or more strings, as well as configurations where one or more sections are not connected in series, such as the arrangement shown in the upper portion of FIG. 9A.

Figure 9A:
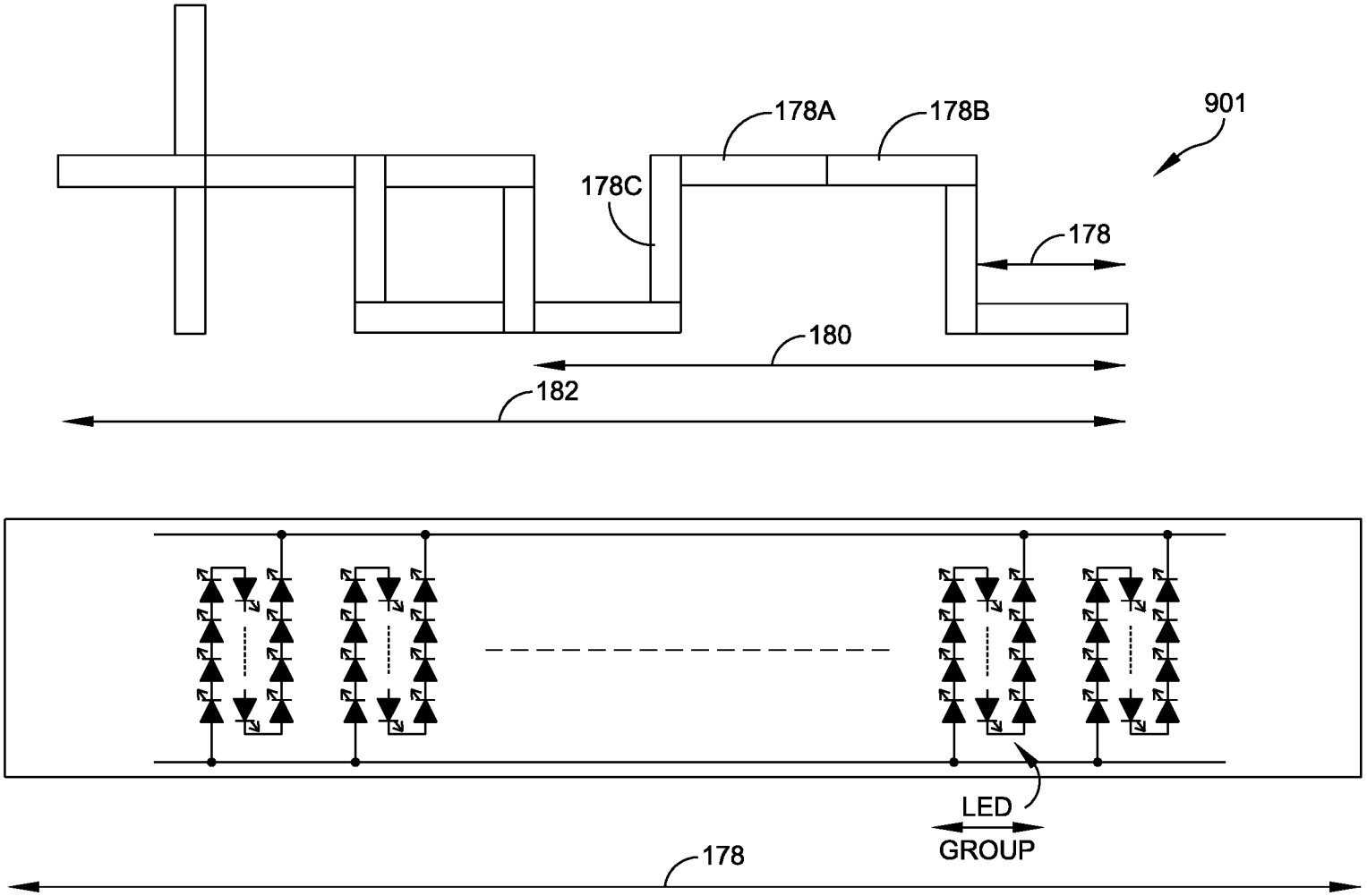
FIG. 9A illustrates a layout of a lighting system in accordance with one or more aspects of the disclosure.

FIG. 9A illustrates a lighting system, generally indicated at 901, that includes a number of sections 178, including a number of sections connected in series to form a string 180, and an array 182 that is formed from the string 180 (on the right) and a number of sections on the left that are connected in parallel or series-parallel (see the square-like and T-like arrangement). The bottom portion of FIG. 9A illustrates how each section 178 may include one or more LED groups, which may be configured as sub-modules as discussed herein.

Figure 9B:
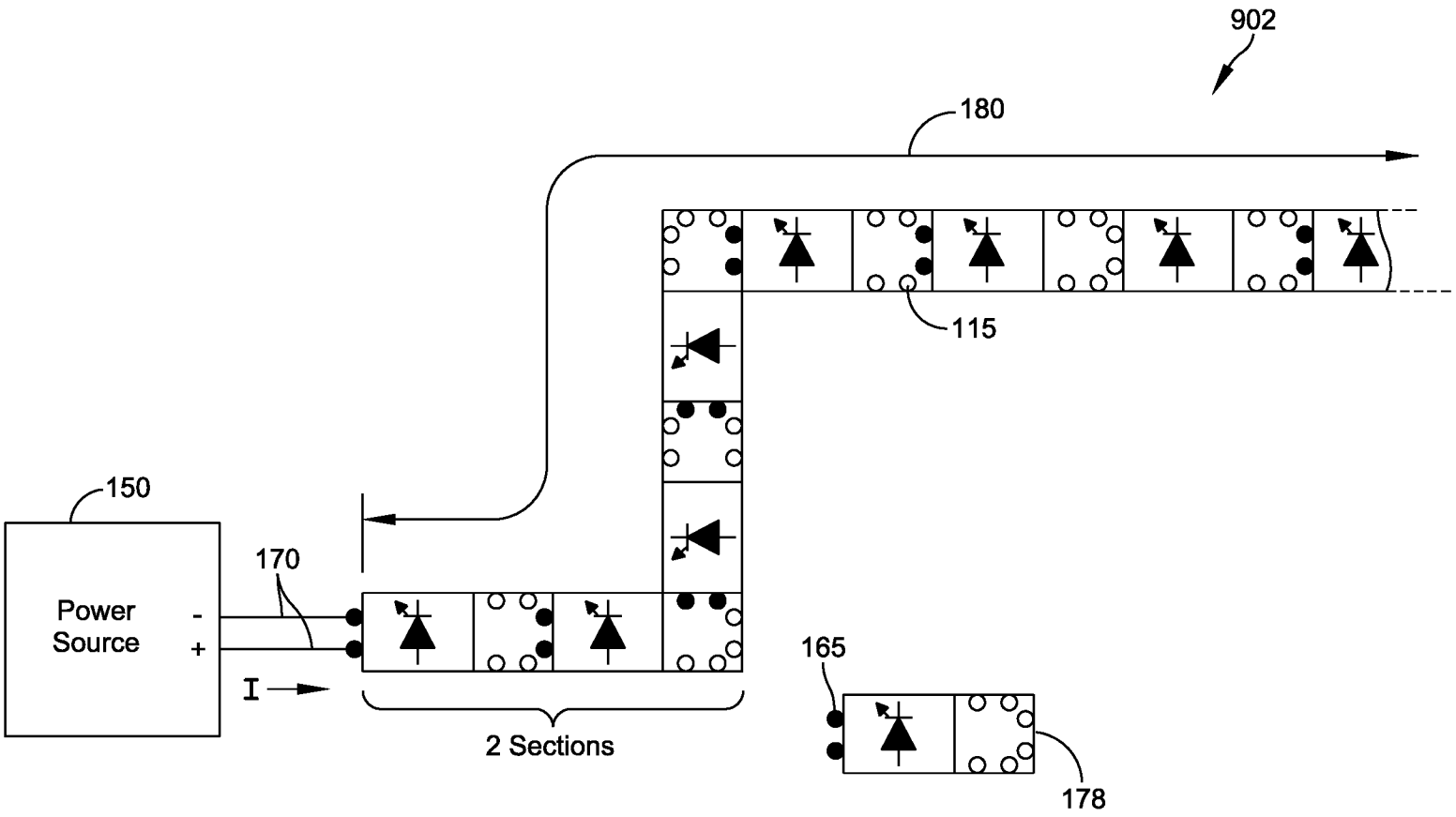
FIG. 9B illustrates another layout of a lighting system in accordance with one or more aspects of the disclosure.

FIG. 9B shows another lighting system, generally indicated at 902, that includes an unbranched number of sections 178 arranged in one string 180 that is connected to a power source 150 using conductive wires or cable 170. In this instance, $V_w=I_o\times R_o\times L/2$, and the voltage drop is the worst for light sources 115 that are located at the most distance point from the power source 150. As shown in FIGS. 9B-9G, and as will be appreciated by one of skill in the art, the power source 150 and conductive wire(s) 170 are configured to include at least one source to power and at least one return, e.g., ground. For example, one conductive wire 170 may be a power conductor and the other conductive wire 170 may be a return conductor, as understood by those skilled in the art. When connected to another module, the power conductor of the first module is electrically connected to the power conductor of the other module, and the return conductor of the first module is electrically connected to the return conductor of the other module.

Figure 9C:
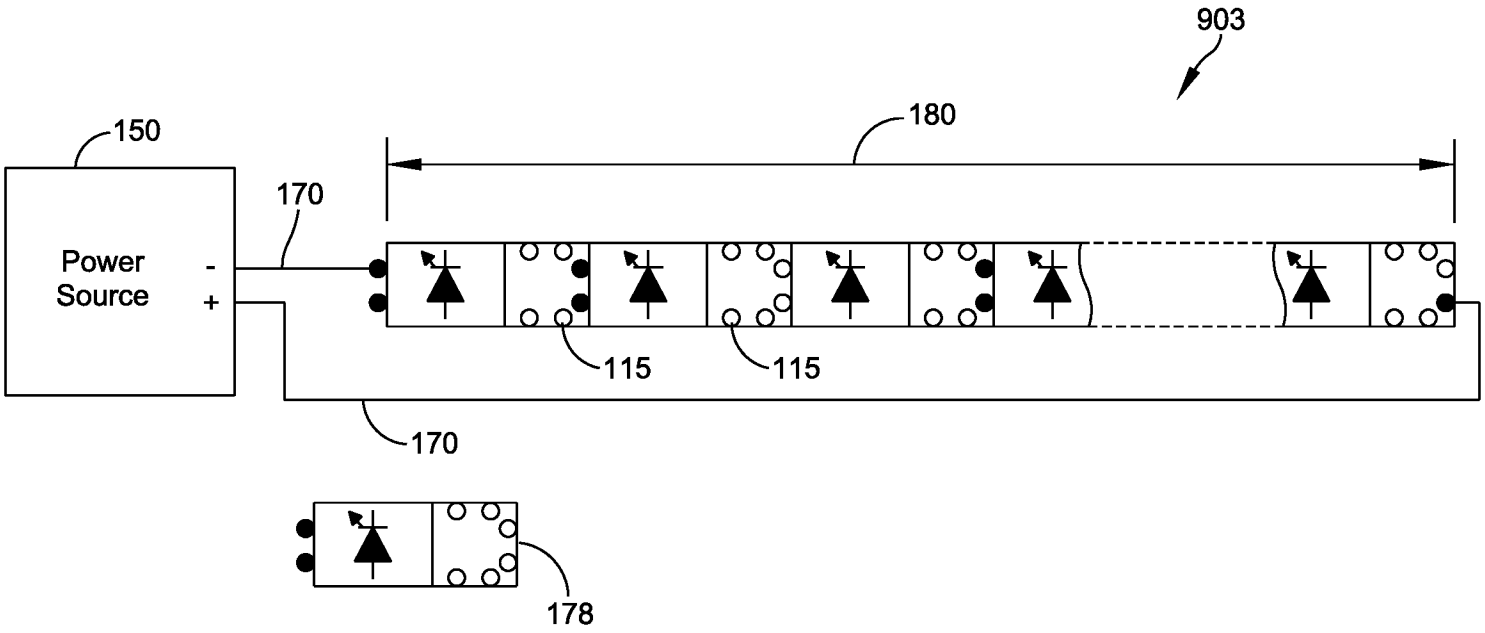
FIG. 9C illustrates yet another layout of a lighting system in accordance with one or more aspects of the disclosure.
Figure 9D:
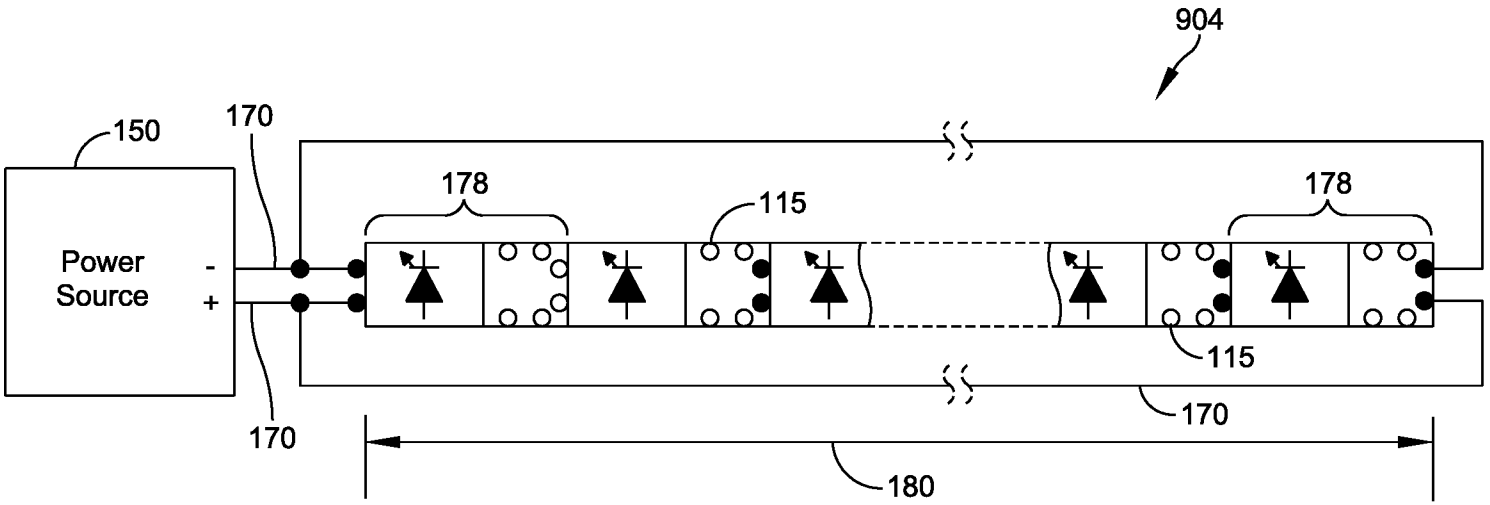
FIG. 9D illustrates yet another layout of a lighting system in accordance with one or more aspects of the disclosure.

FIG. 9C is another embodiment of a lighting system, generally indicated at 903, that includes an unbranched string 180 comprised of a series of connected sections 178. According to this embodiment, a conductive wire 170 is fed as a single wire feed to both ends of the string 180. In this instance, $V_w=I_o\times R_o\times 3L/8$, and the voltage drop is the worst for light sources 115 that are located at the midpoint of the string 180, but the value is only 75% of the worst-case value for Vw associated with the configuration shown in FIG. 9B. FIG. 9D is another embodiment of a lighting system, generally indicated at 904, that includes an unbranched string 180 of a series of connected sections 178. This embodiment different from the one shown in FIG. 9C in that the conductive wire 170 is fed as a two wire feed to both ends of the string 180, which is the electrical equivalent of deploying the sections 178 in a single closed loop, with the power supply 150 bridged into the loop at an arbitrary point. This effectively cuts the effect of resistive losses associated with the conductive substrate by a factor of four in comparison to the single unbranched, single-end powered arrangement shown in FIG. 9B. In this instance, $V_w=I_o\times R_0\times L/8$, and the voltage drop is the worst for light sources that are located at the midpoint of the string 180, but the value is only 25% of the worst-case value for Vw associated with the configuration shown in FIG. 9B.

Figure 9E:
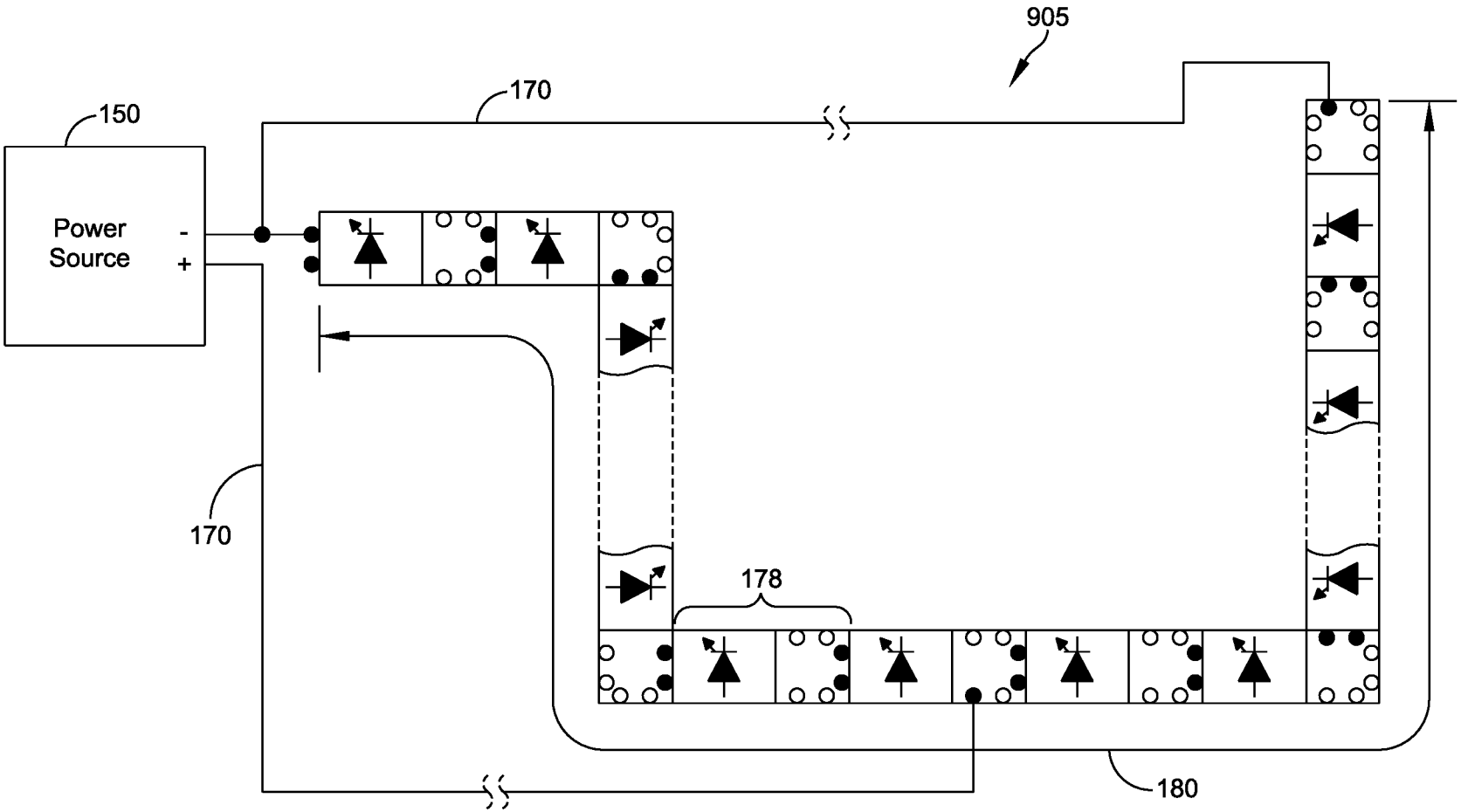
FIG. 9E illustrates yet another layout of a lighting system in accordance with one or more aspects of the disclosure.
Figure 9F:
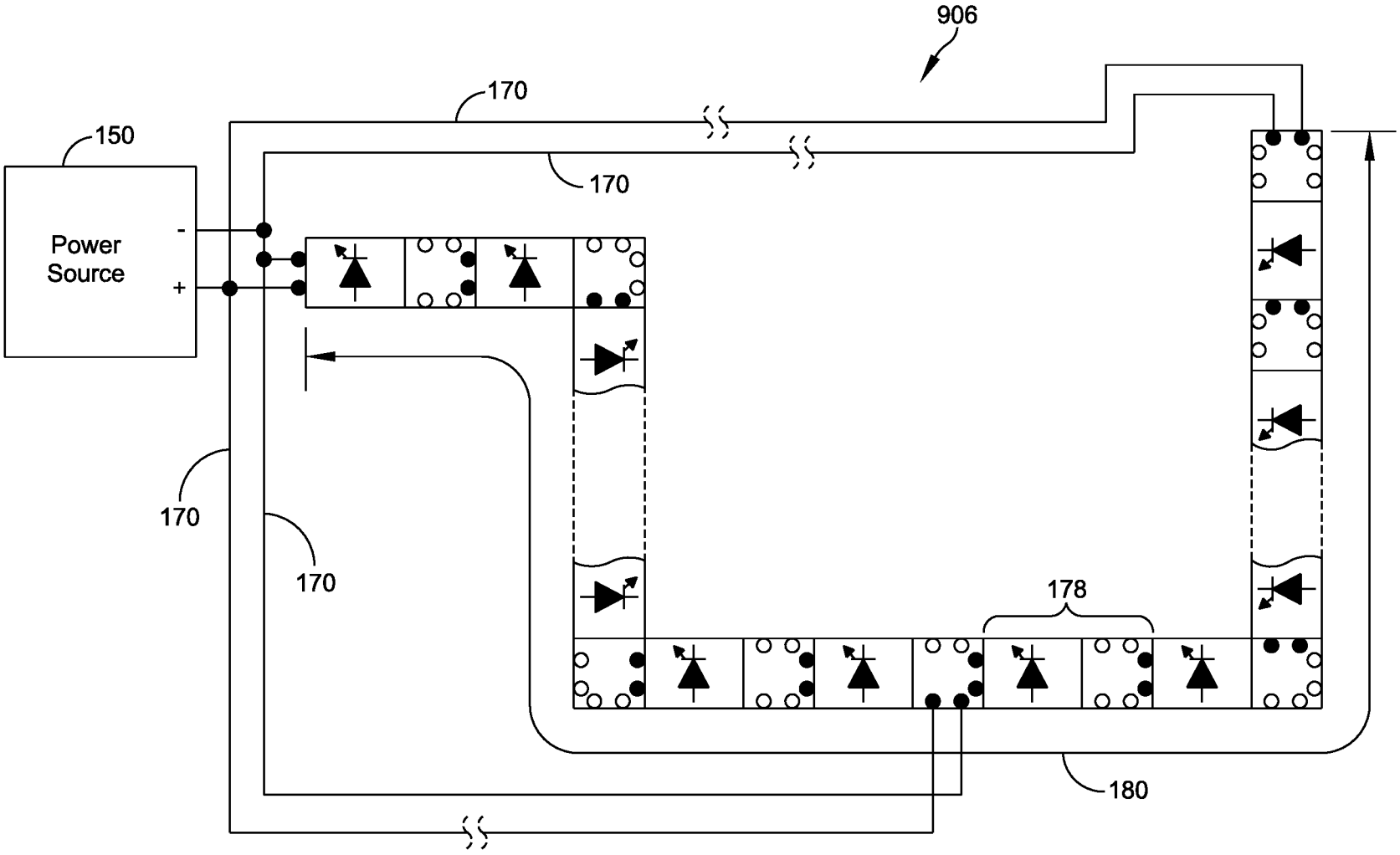
FIG. 9F illustrates yet another layout of a lighting system in accordance with one or more aspects of the disclosure.

FIG. 9E is another embodiment of a lighting system, generally indicated at 905, that includes an unbranched string 180 of connected sections 178 that includes a conductive wire 170 that is fed as a single wire feed to both ends of the string 180 and to a mid-point location. In this instance, $V_w=3\times I_o\times R_o\times L/32$, and the voltage drop is the worst for light sources that are located at the L/4 and 3L/4 locations of the string 180 from the power supply 150. However, these values are only ~19% of the worst-case value for Vw associated with the configuration shown in FIG. 9B. FIG. 9F is another example of an embodiment of a lighting system, generally indicated at 906, that is similar to the configuration shown in FIG. 9E, but in this instance the conductive wire is fed to both ends and the midpoint of the string 180 as a two wire feed. This is the electrical equivalent of deploying the sections 178 in two closed loops that intersect at the point where power is applied by the power supply 150. In this instance, $V_w=I_o\times R_o\times L/32$, and the voltage drop is the worst for light sources that are located at the L/4 and 3L/4 locations of the string 180 from the power supply 150, but these values are only ~6% of the worst-case value for Vw associated with the configuration shown in FIG. 9B.

Figure 9G:
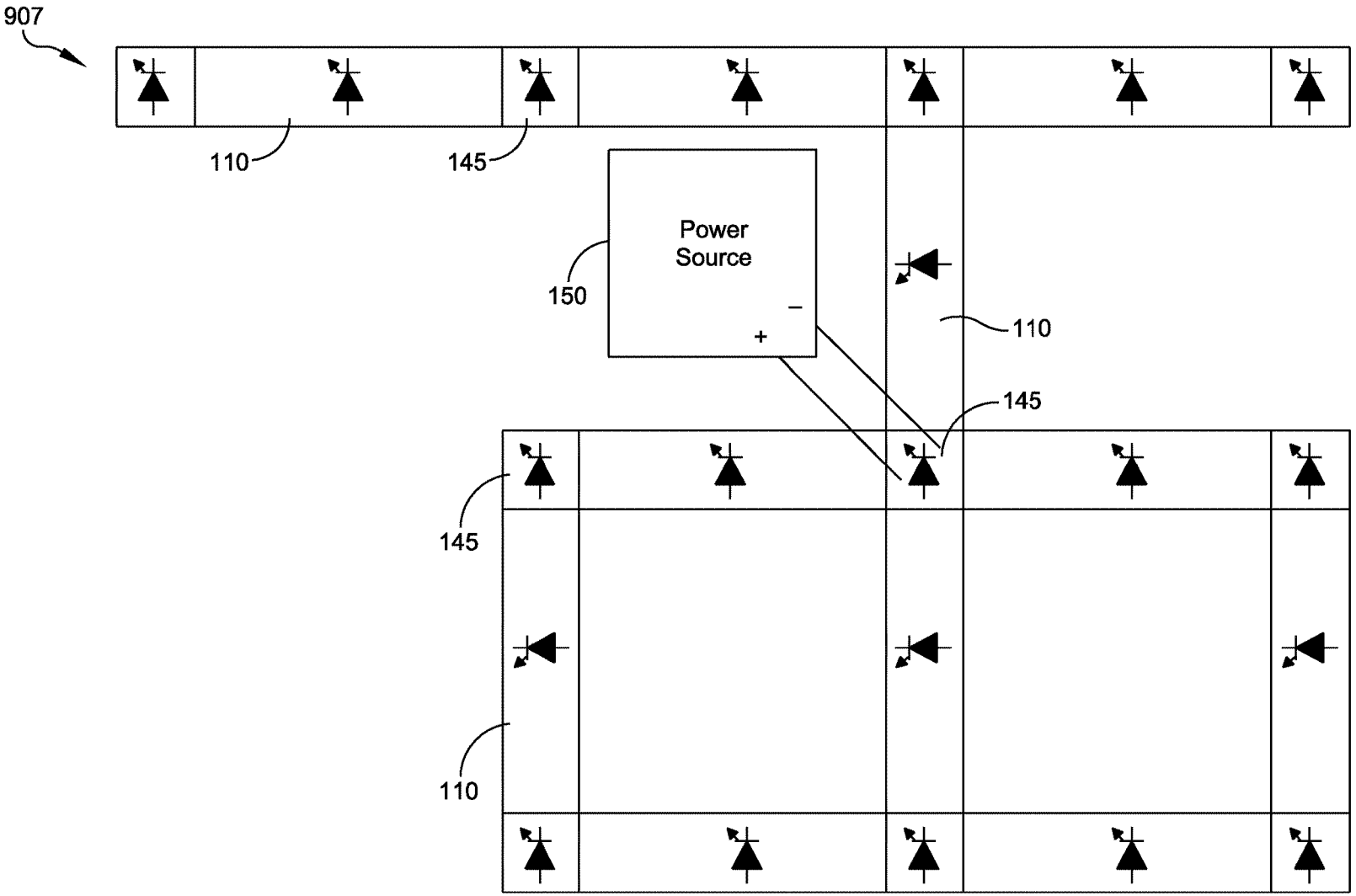
FIG. 9G illustrates yet another layout of a lighting system in accordance with one or more aspects of the disclosure.

FIG. 9G illustrates another embodiment of a lighting system, generally indicated at 907, that features a plurality of lighting modules 110 and connection modules 145 arranged in a closed loop configuration (see bottom portion). The closed loops formed from the lighting and connection modules further reduce the amount of resistance losses associated with the conductive substrate (in this instance a PC board) below that possible without having to resort to augmenting the configuration with extensive external wiring on unbranched or open branched configurations. For example, this particular configuration minimizes resistance losses by positioning the power supply 150 at a location that is nearest the maximum branched point.

Figure 3:
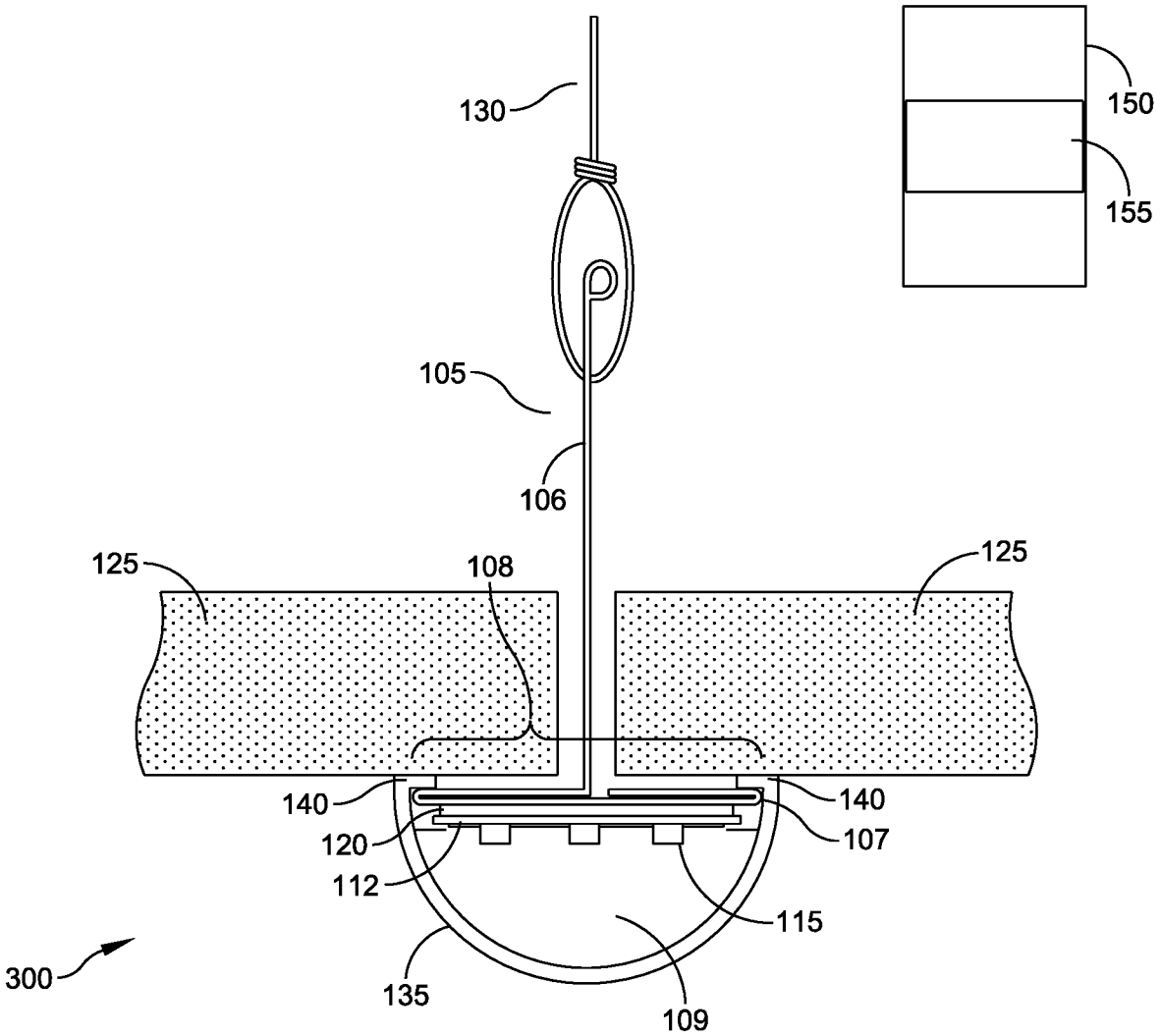
FIG. 3 is a generalized cross-sectional view of yet another lighting system in accordance with one or more aspects of the disclosure.

Referring to FIG. 3, a side view of a lighting system, generally indicated at 300, is shown. As depicted, the side view is of a lighting module 110. The lighting system 300 and other lighting systems discussed herein are configured to use with a grid ceiling, as discussed above, and are configured to emit light for the purposes of illuminating an area or portion of a room or exterior environment. According to some embodiments, the lighting systems disclosed herein may take the form of a lamp-like structure. For example, the lighting systems may be used to illuminate all or a portion of a room, such as a basement, or office, in the form of a ceiling light fixture used with a grid ceiling system. The lighting systems may also be used for back-lighting, security lighting, night lighting, and signage or display lighting applications. In other embodiments, the lighting systems may be combined with another source of light to provide additional or supplemental lighting. For example, a room constructed with a grid ceiling system may include a first source of lighting positioned in one or more of the grid openings, such as recessed halogen lamps, or a troffer configured with fluorescent lights. The lighting systems of the present disclosure may therefore be used as a second, supplemental light source, for example, for emergency or accent lighting. In other examples, the lighting systems may function as the primary source of lighting in a designated space.

Referring again to FIG. 3, the lighting system 300 includes attachment member 120 for attaching a lighting module 110 to the T-bar 105. For example, a top surface of the conductive substrate 112 of the lighting module 110 (which may further include the connection module 145, as discussed below in reference to FIG. 11) is secured to a bottom surface of the attachment member 120. The top surface of the attachment member 120 is secured to the bottom exposed surface of the horizontal section 107 of the T-bar 105.

According to some embodiments, the light source 115 may be a low voltage light source. For example, the light source 115 may include one or more LEDs. The LEDs may be arranged in an array of multiple LEDs, and may be configured to electrically couple so as not to exceed Class 2 wiring restrictions. For example, the array of LEDs may not exceed a power density of 4 W/ft, or each lighting system 300 may not exceed 100 VA, although a room may contain more than one lighting system 300. One example of an array may include LED strip lighting. For example, 12 low power LEDs (which may be commercially available type 3528 LEDs) may be installed per running inch (length) of the T-bar 105. The strip of LEDs may be configured to not exceed 37 mW/LED or 400 lm/ft. As will be appreciated by one of skill in the art, the light source 115 may contain arrays of LEDs configured in many different arrangements, such as the 4×3 arrays discussed above in reference to FIGS. 7A-7C. For example, the LEDs may form a linear pattern, a grid, an alternating pattern, or any other configuration to suit a particular lighting application.

According to some embodiments, one or more of the LEDs in the array may emit light of a certain wavelength and different LEDs may emit light of a different wavelength. For example, one or more of the LEDs may be emit blue light and other LEDs may emit red light. A diffuser 135, discussed in further detail below, may be constructed from or coated with a material that converts at least a portion of the blue light into yellowish-green light or greenish-yellow light so that a mixture of light exiting the lighting system 300 is perceived as white light. According to other embodiments, the LEDs in the array emit light of the same wavelength. Other known low voltage light sources, such as incandescent printed circuit board lights, compact illuminators, electroluminescent devices, and the like, are also within the scope of this disclosure.

The low voltage light sources 115, such as LEDs, are mounted on, and electrically attached to the conductive substrate 112. According to some embodiments, the conductive substrate 112 is a metal-core PCB. Metal-core PCBs, also referred to as integrated metal substrates, are suitable for one or more embodiments disclosed herein. A metal-core PCB includes a metal, such as aluminum, that serves as a base, onto which a dielectric layer is applied. A layer of copper is positioned on top of the dielectric layer. The light sources 115, such as LEDs, may be disposed onto the copper layer, which acts as a circuit layer for electrical connections. The conductive substrate 112 may be provided in a wide variety of shapes and sizes to accommodate the different dimensions of the lighting module 110 and the connection module 145. For example, the conductive substrate 112 may be square in shape, such as a 1×1 inch square. In other examples, the conductive substrate may be rectangular in shape, such as 12×1 or 24×1 (inches). In other examples, the conductive substrate 112 may be combined with other conductive substrates 112 to form a wide variety of shapes and sizes. Other shapes and sizes for the conductive substrate 112 are within the scope of this disclosure, including elongated, rectangular and/or linear strips, circular shapes etc. Further, the conductive substrate 112 may be constructed from flexible materials, allowing one or more sections to be configured into different shapes and sizes. For example, the sections may be interconnected into one or more closed rings and/or branches, which in certain instances may reduce or eliminate the need for additional wire or cabling material.

According to at least one embodiment, the conductive substrate 112 is a substrate formed from a PC board having a first conductive layer, a second conductive layer, and a dielectric layer separating the first conductive layer and the second conductive layer. The light source(s) 115 and connector(s) 160 are disposed on the first conductive layer and the second conductive layer may be constructed and arranged to transfer heat generated from the light source 115 to the T-bar 105. According to a further embodiment, the second conductive layer is formed from a conductive material that covers substantially all of a surface of a lighting module that is disposed proximate the T-bar. For instance, the conductive material may cover at least 90% of the surface of the lighting module that is disposed proximate the T-bar. According to this embodiment, etchable copper conductive foil used in a printed circuit board (i.e., conductive substrate 112), is configured to have the minimum amount of copper etched away. For example, all nodes may be shorted together initially, and then just enough of the copper foil is removed to isolate groups of connected nodes defined by a specific circuit design. Conventional methods take the opposite approach, in that conductive traces of conductive material are added in between nodes to achieve the desired circuit design. According to various embodiments of the present invention, at least 90%, or even at least 95% of the copper foil material remains, which allows for larger areas of copper material, including oversized pads. This results in not only enhanced heat dissipation, but also minimizes residual unintended circuit resistances, which can impose significant power losses.

According to some embodiments, the conductive substrate 112 includes a top surface and a bottom surface, where the top surface faces the exposed surface of the T-bar and the bottom surface faces down into the space below the ceiling, where the bottom surface includes a conductive material. One or more solid state light emitters, such as LEDs, may be mounted on this bottom surface. For example, copper traces may be printed on the top or bottom surface (or both) or in a middle layer of the board to electrically interconnect the LEDs. As shown above in FIGS. 7A-7C and 8, wider traces can be used for power and ground lines between lighting modules 110 and between one or more lighting modules 110 and connection modules 145, and thinner traces can be used for lower current applications, such as electrically connecting one light source 115 to another. According to some embodiments, the conductive substrate 112 may be constructed from alternating layers of electrically nonconductive, i.e., insulating, and conductive materials. The conductive layers may form one or more plane layers and may be selectively etched to create circuit traces, such as those shown above as connective pathway 176 in FIGS. 7A-7C and 8. In some embodiments, the conductive substrate 112 is a single layer PCB. In other embodiments, the conductive substrate 112 is a multi-layer PCB. In certain embodiments, a multi-layer PCB, such as a two-layer PCB, has certain advantages, since the layout of the circuit pattern may be simplified, which reduces trace resistances and power losses. In addition, a multi-layer PCB substrate is less likely to warp, and may use thinner copper layers which may reduce material costs. Multi-layer PCBs may also include larger pads, which improves efficiencies associated with heat dissipation. It will be appreciated that the conductive substrate 112 also includes at least one pad where components, such as a light source, resistor, connector, rectifier, or any other electrical component suitable for use in the lighting systems discussed herein may be electrically attached to the conductive material, i.e., copper, of the conductive substrate using solder techniques or any other suitable attachment method. Any number of light sources 115 may be mounted on the conductive substrate, as discussed above. The conductive substrate 112 may support any type of light source 115, such as LEDs, and the light source 115 may be attached in any number of suitable ways, non-limiting examples including chip-on-board technology, such as direct die attachment, surface mounting, or through-hole attachment.

In accordance with certain aspects, the light source 115 may be powered by a low voltage power supply 150, which allows for minimal housing, since no electrical isolation measures are required. The low voltage power supply may be integrated into the grid ceiling using the T-bars 105, for example, through the use of one or more conductive wires 170, as shown in FIG. 12. In certain instances, the conductive wire 170 may be constructed from an electrically conductive material such as copper and formed as a single wire or a plurality of wires bound together. The conductive wire 170 may also be coated with an insulating material. In some embodiments, the conductive wire 170 may be a flexible wiring such as that used for consumer electronics, a power cable, or any other flexible conductive material that is suitable for the lighting systems as discussed herein. According to some embodiments, one or more components of the lighting module 110 and/or the connection module 145 may be configured to accommodate connection to the power supply 150. For example, the diffuser 135 may be sized or otherwise configured to accommodate the conductive wire 170 or other type of connection to a power source. Further, the T-bar 105 may contain one or more openings or other feature for accommodating a connection such as the conductive wire 170 to a power source. According to a further embodiment, the T-bar structure itself may contain the connection to the power supply, i.e., the conductive traces.

According to a further embodiment that is not shown, the T-bar may also function as the conductive substrate upon which the light source and other supporting circuitry are directly mounted. This embodiment may significantly reduce material costs, since a separate conductive substrate, such as a printed circuit board, and the attachment member can be eliminated. For example, a polymer or other dielectric insulator and a conductive layer may be overlaid directly to the surface of the T-bar, or the conductive substrate may form the entire T-bar. This design also takes advantage of the Class 2 voltage power levels, since there is no safety hazard in the event that a fault or short develops in the laminated dielectric layer between the light source circuitry and the underlying T-bar.

According to a further embodiment, the T-bar of the suspended ceiling system may be supplied with the lighting module 110 and/or connection module 145 already pre-attached. For example, the lighting module 110 may be pre-laminated onto a length of T-bar 105 and electrically and mechanically connected to another T-bar 105 that includes at least one lighting module 110 and/or connection module 145. This particular embodiment may be useful for new installations, since the grid and lighting can be installed at the same time.

In accordance with one or more embodiments, one or more of the light sources 115 may be covered by a diffuser 135. For example, LEDs may dispense discrete sources of light, making the light emitted from them appear as concentrated beams. A diffuser 135 may be used in combination with the light source 115, such as LEDs, to spread out the light. The diffuser 135 may function to uniformly distribute the light over the surface of the light source 115 with little light loss. The diffuser 135 may be sized to fit over one or more of the light sources 115 and may be constructed from any one or a number of materials, such as a polymer or polymer composite material. For example, the diffuser 135 may be made from a hard plastic, such as acrylonitrile butadiene styrene (ABS), nylon, polystyrene, polycarbonate, polymethyl methacrylate (PMMA), or a combination thereof. The diffuser 135 may be made from materials having a high transmission coefficient. According to other embodiments, the diffuser 135 may be made from materials with properties that allow the diffuser 135 to have low reflectivity, high transmissivity, and high diffusivity. In certain instances, the diffuser 135 may be constructed from one or more sheets of material; thereby forming a laminate structure. In some embodiments, diffusion particles are embedded into the diffuser. According to certain embodiments, the diffuser may be coated with one or more materials to create a certain lighting effect and/or to assist in diffusing the emitted light. The diffuser 135 may also include an integrated color filter. For example, the diffuser 135 may be embedded with a color pigment, such as titanium dioxide. According to some embodiments, the diffuser is constructed from a clear, high transmissivity polymer that is embedded or entrained with randomly disposed small particles that have a different refractive index than the host polymer. This allows the light rays to bend slightly as the light encounters each of the particles to create a diffusing effect. In at least one example, the diffuser 135 has a dome shape or appearance. Other shapes are also within the scope of this disclosure.

In some embodiments, the diffuser 135 attaches to the T-bar 105 through one or more clips 140 or grooves that are positioned at one or more edges of the diffuser 135. For example, referring back to FIG. 3, the diffuser 135 may have a hemispherical shape that terminates in attachment clips 140 positioned on opposite sides. The attachment clips 140 are configured to secure the diffuser 135 by snapping onto a portion of the top surface of the horizontal section 107 of the T-bar 105. The ceiling tiles 125 may then rest on the top of the clips 140, instead of being positioned directly onto the T-bar 105. Other methods for attaching the diffuser 135 are also within the scope of this disclosure. For example, in some embodiments, the diffuser 135 may be directly attached to the bottom surface, i.e., exposed surface, of the horizontal section 107 of the T-bar without the use of clips. The diffuser 135 may also be directly attached to the conductive substrate 112. The diffusers 135 may also be shaped and sized to accommodate each of the lighting modules 110 and the connection modules 145. For example, the diffuser 135 may be 24 inches in length to accommodate one or more sections of lighting module 110 and/or connection module 145 that have a length or a combined length of 24 inches. In other examples, the diffuser 135 may be 12 inches or 48 inches in length. In other examples, the diffuser 135 is shaped and sized to fit onto at least a portion of both the lighting module 110 and the connection module 145. For example, a diffuser 135 may be sized and shaped to fit over a connection module 145 and a portion of a lighting module 110; thereby forming a right angle. Further, a diffuser 135 for a connection module 145 may be shaped to mate with a diffuser 135 attached to a lighting module 110. FIGS. 10A-10J contains several different embodiments of exemplary diffusers which are included within the scope of this disclosure. For example, diffusers sized for the connection module 145 can be configured to snap over the junction of one or more longer diffuser sections that are sized for the lighting modules 110, or in the alternative, they may be sized to fit under the longer diffuser sections, and are therefore held in place by the longer diffuser sections.

Figure 4:
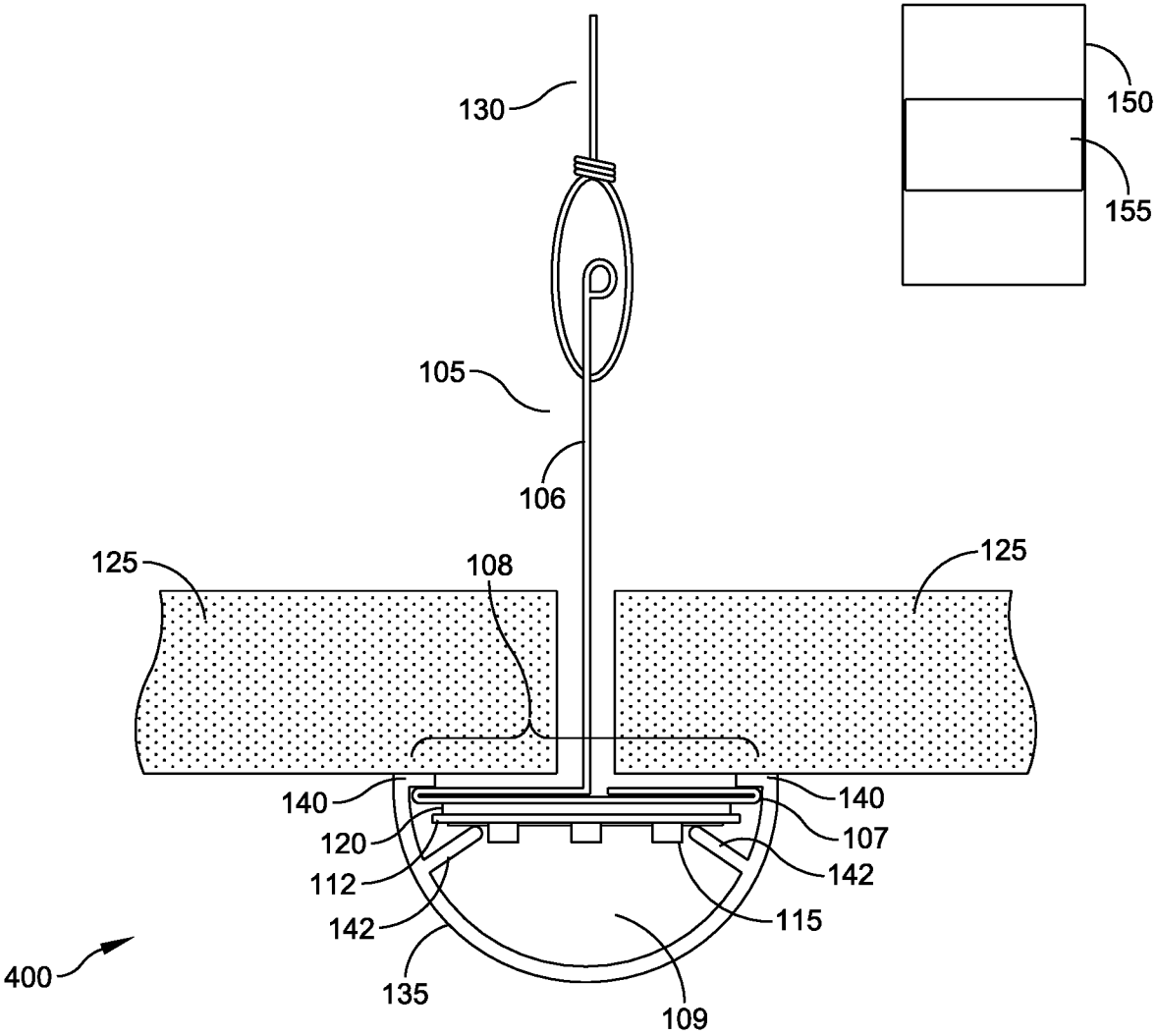
FIG. 4 is a generalized cross-sectional view of yet another lighting system in accordance with one or more aspects of the disclosure.

Referring to FIG. 4, an alternative embodiment is shown for a lighting system 400 that is similar to that shown in FIG. 3, but with a diffuser 135 that further includes a longitudinal ridge 142 positioned on opposing interior side surfaces and extending along the length of the diffuser 135. As illustrated, the longitudinal ridge 142 functions to press the conductive substrate 112 against the horizontal section of the T-bar 107 once the clips 140 have engaged with the edges of the horizontal section of the T-bar 107. According to other embodiments, the longitudinal ridge 142 may be used to secure the lighting module 110 and/or connection module 145 in a position proximate the T-bar 105. Further, the diffuser 135 may include a plurality of longitudinal ridges that extend along the length of the diffuser that are configured to secure the lighting module 110 and/or connection module 145 in registration with T-bar 105. Thus, the longitudinal ridge 142 may be used in lieu of the attachment member 120 and/or the attachment clips. In the embodiment shown in FIG. 4, the attachment member 120 is a thermal grease or other thermally conductive gap filling medium that is adhered only to the conductive substrate 112. This arrangement allows for any one or more of the lighting modules 110 to be removed and/or replaced, redeployed into a different configuration, or moved to a different location over and over again with minimal loss or damage to either the modules or to the supporting grid system. An additional benefit with this arrangement is that there is also no requirement for adhesives or magnetic strips or any other separate fastening hardware, which reduces material costs. In this embodiment, the diffuser 135 may function to secure the lighting module 110 to the bottom surface of the T-bar 105.

Figure 10A:
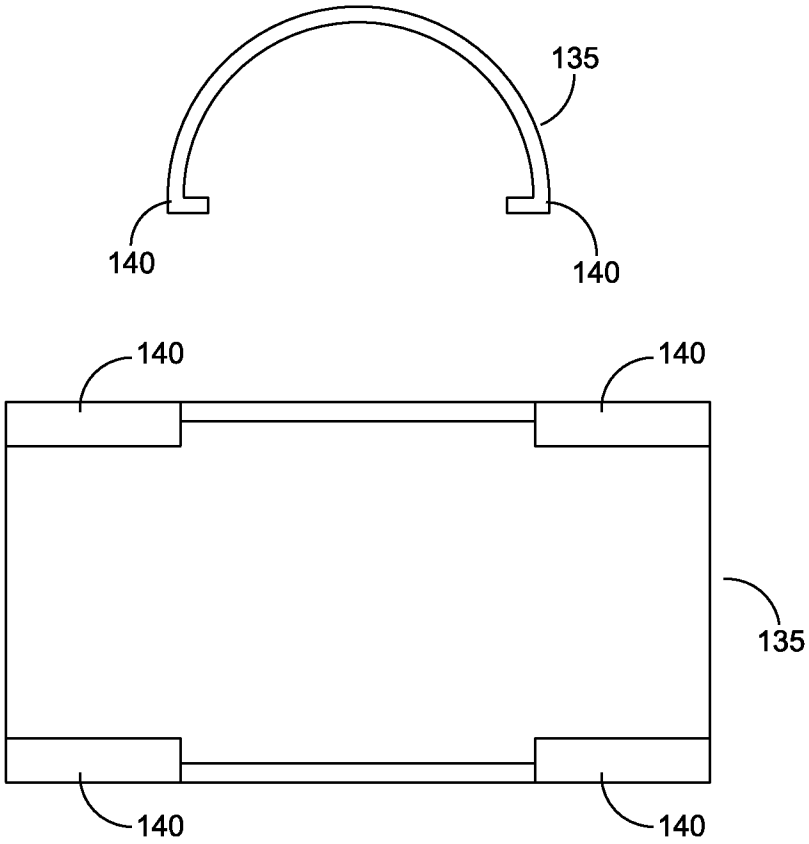
FIG. 10A is a side and top view of a diffuser in accordance with one or more aspects of the disclosure.

Referring to FIGS. 10A-10J, a number of different embodiments are shown that exemplify different configurations for the diffuser 135. For example, FIG. 10A shows a side view (top portion of figure) and a top view (bottom portion of figure) for a diffuser 135 that includes attachment clips 140, as described above, that snap onto a portion of the top surface of the horizontal section of the T-bar such that the ceiling tiles of the suspended ceiling system rest on top of each clip 140. According to one embodiment, the diffuser 135 of FIG. 10A may be used in combination with a connection module 145. For example, the center portion of the diffuser may be positioned over a connection module 145, and a portion of each lengthwise end may (optionally) be positioned over, i.e., overlap two connecting lighting modules 110, such as the sections labeled 178A and 178B shown in FIG. 9A. According to some embodiments, the diffuser 135 of FIG. 10A may be used as a splice that covers a portion of one or more underlying diffusers, such as two lighting modules 110 that are each fitted with diffusers and are connected lengthwise by a connection module 145 that does not include a diffuser. The diffuser 135 in any of the embodiments discussed herein may be constructed from at least one of a notched extrusion, single, or double slide injection mold manufacturing processes.

Figure 10B:
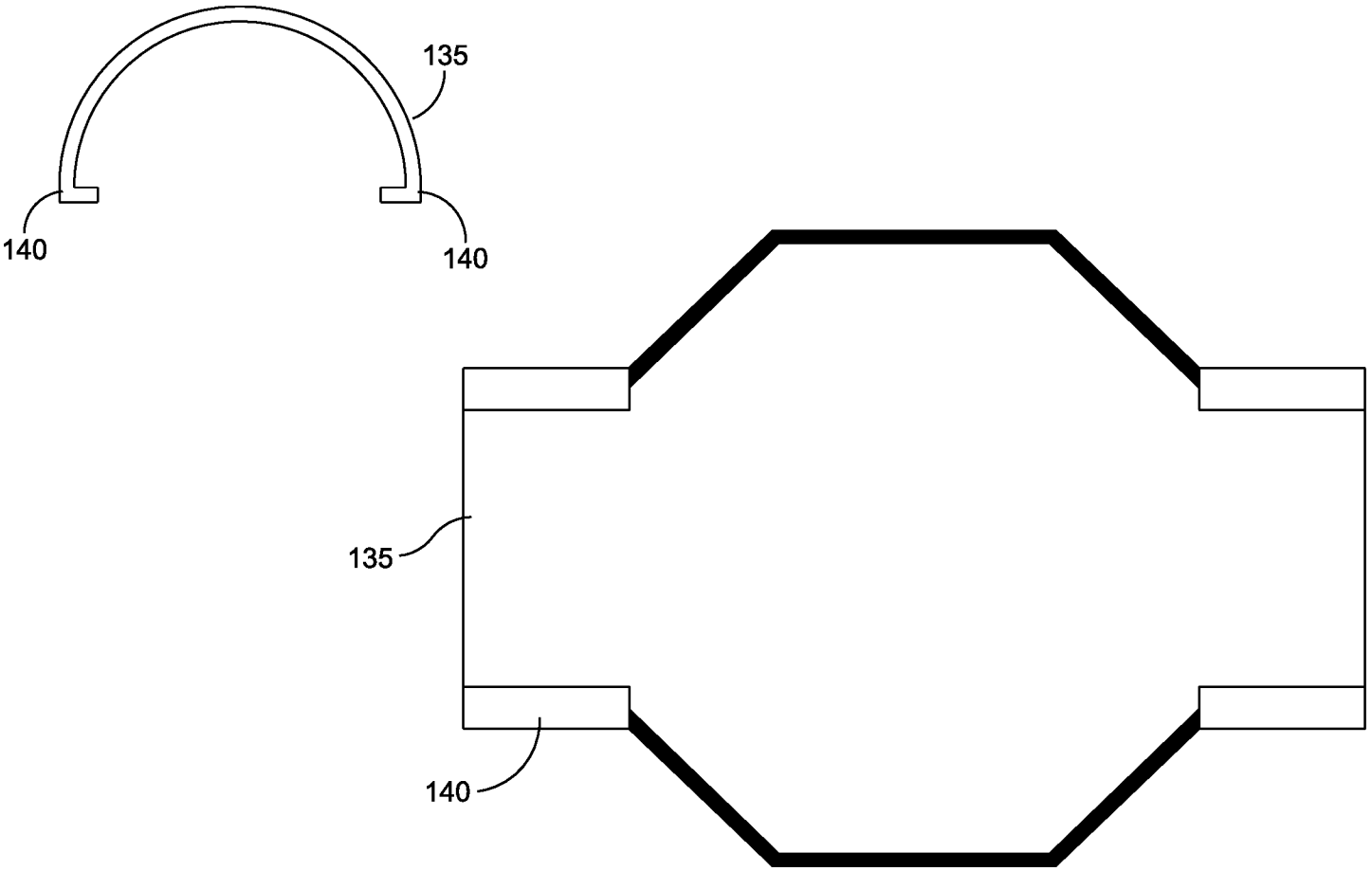
FIG. 10B is a side and top view of another diffuser in accordance with one or more aspects of the disclosure.

FIG. 10B shows a side and top view of another embodiment of a diffuser 135 that is attached to the T-bar using at least one clip 140, but is configured to include a region on either side that allows for power exit/entrance, such as for accommodating at least one conductive wire 170, a connector 160, and/or an interconnection device 165. According to another embodiment, the diffuser 135 shown in FIG. 10B is configured to cover a connection module 145 (which would be positioned in the center) and at least a portion of two lighting modules 110 that are connected on opposite edges of the connection module 145 (lengthwise). In certain instances, the diffuser 135 shown in FIG. 10B may be used as a splice that covers portions of two underlying diffusers that cover the two connected lighting modules and completely covers a connection module 145.

Figure 10C:
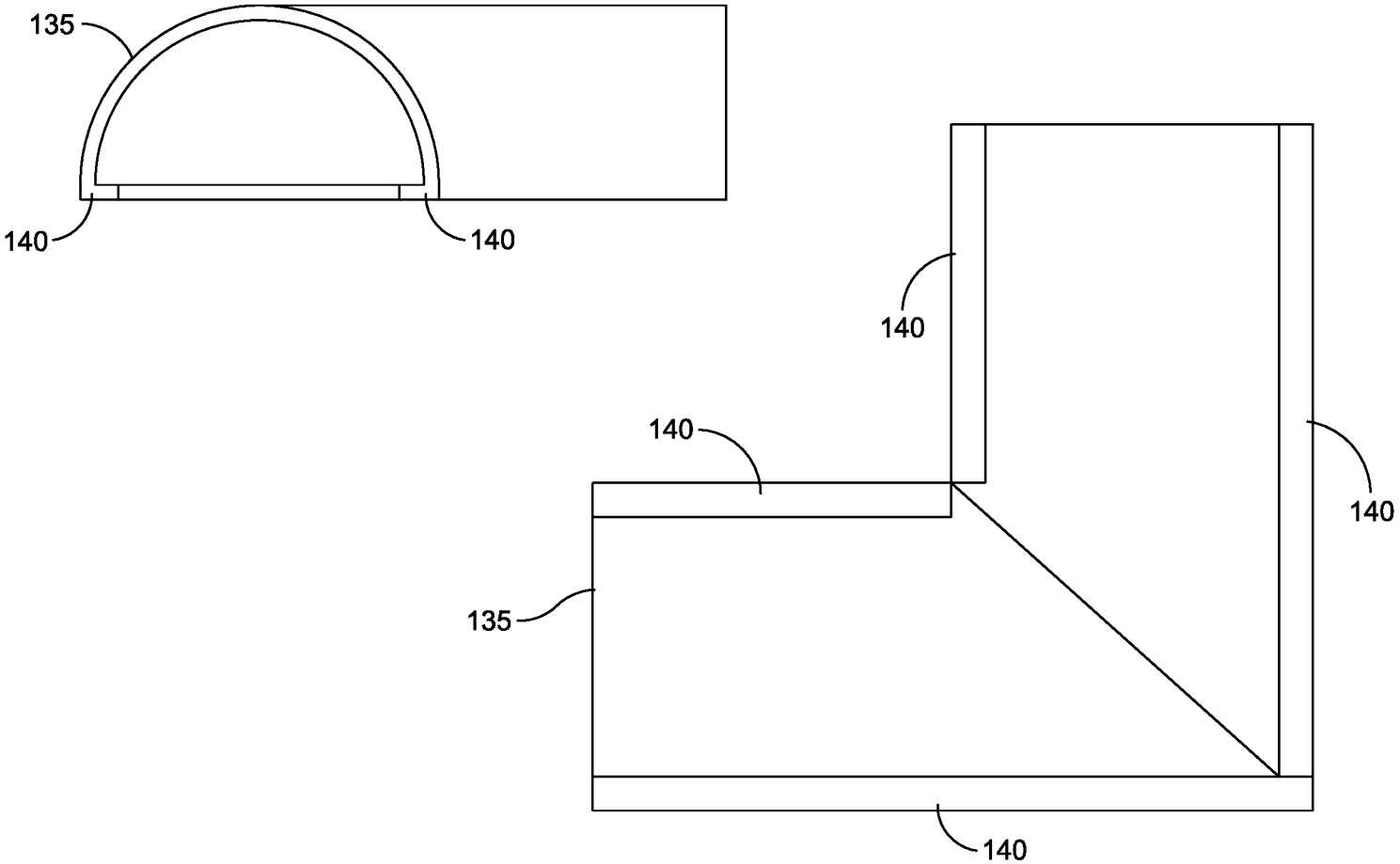
FIG. 10C is a side and top view of yet another diffuser in accordance with one or more aspects of the disclosure.

FIG. 10C shows a top and side view of a diffuser 135 that is configured for a lighting system that includes a right angle, such as the sections labeled 178A and 178C shown in FIG. 9A. For example, two perpendicular lighting modules 110 may connect to a connection module 145 positioned at their intersection. In this embodiment, the diffuser 135 also attaches to the T-bar using at least one clip 140. According to at least one embodiment, the diffuser 135 shown in FIG. 10C is configured as a splice and is designed to cover at least a portion of one or more underlying diffusers. For instance, the two perpendicular lighting modules 110 may each include a diffuser and the connection module 145 may not. Thus, this configuration allows light sources included in the connection module 145 to be covered by a diffuser.

Figure 10D:
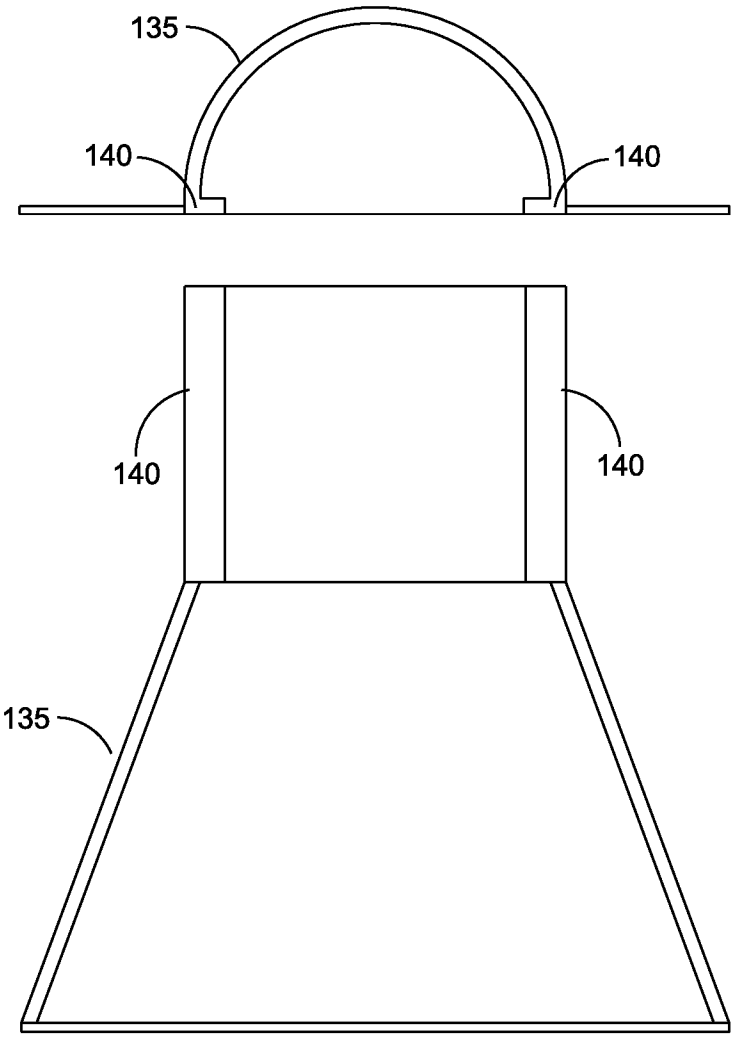
FIG. 10D is a side and top view of yet another diffuser in accordance with one or more aspects of the disclosure.

FIG. 10D shows a top and side view of another embodiment of a diffuser 135 that is configured to function as an end cap positioned at one end of a lighting module 110 and includes a "flared" region that is designed to accommodate at least one conductive wire 170, i.e., power cord, exiting or entering the lighting module. For instance, in this embodiment, the diffuser 135 may attach to one end of a lighting module 110, such as the end of a section 178 as discussed above. As shown, the diffuser also includes at least one attachment clip 140 for attachment to the T-bar.

Figure 10E:
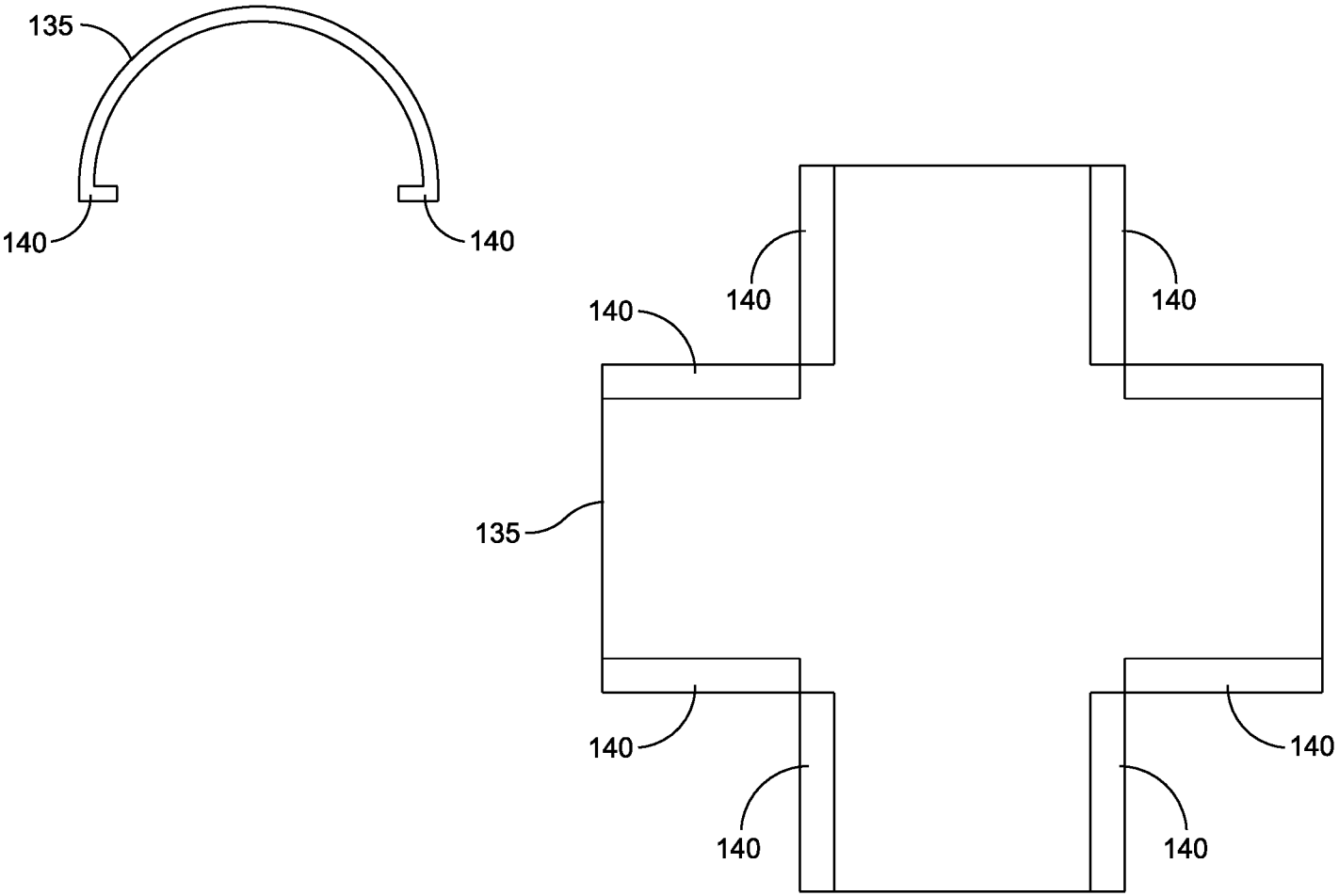
FIG. 10E is a side and top view of yet another diffuser in accordance with one or more aspects of the disclosure.
Figure 10I:
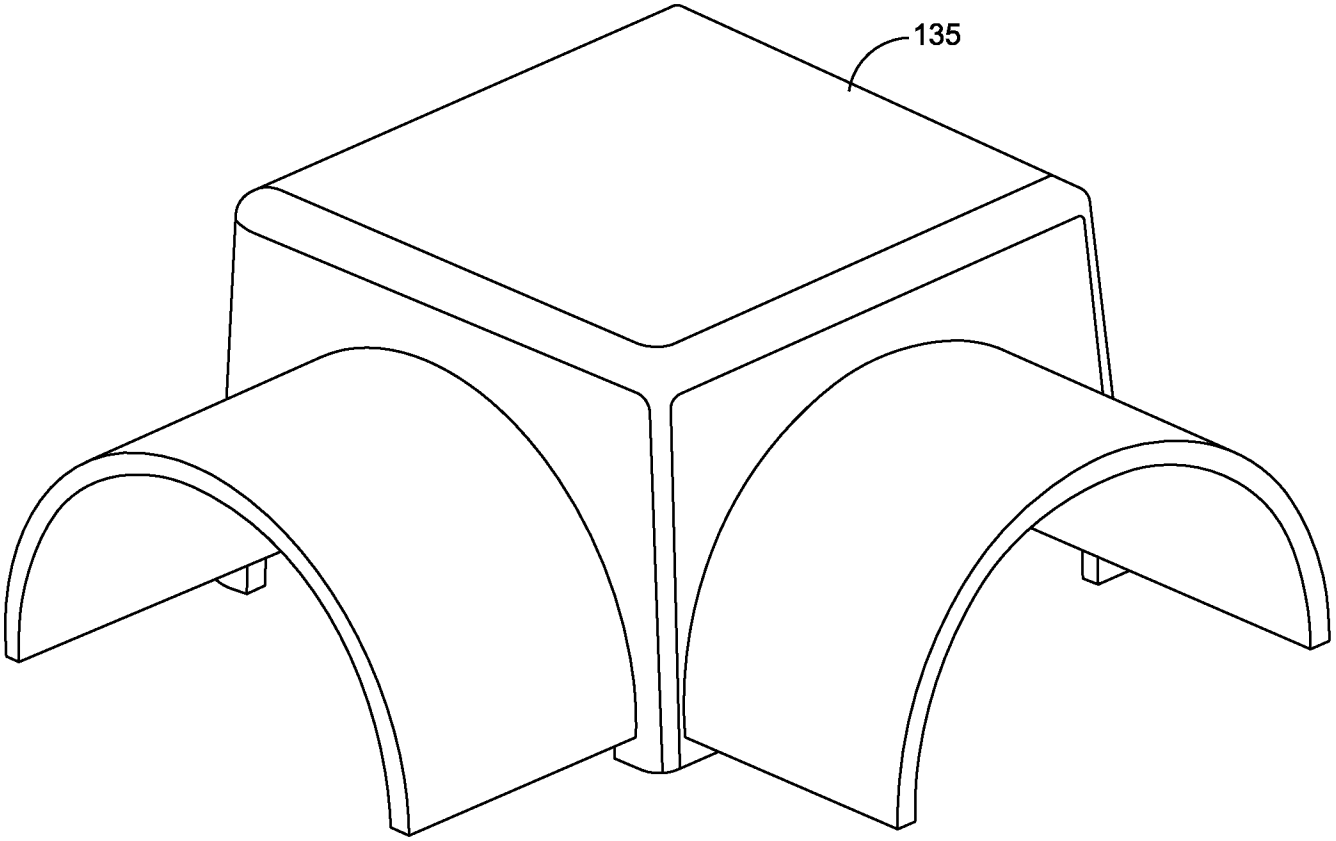
FIG. 10I is perspective view of yet another diffuser in accordance with one or more aspects of the disclosure.
Figure 10J:
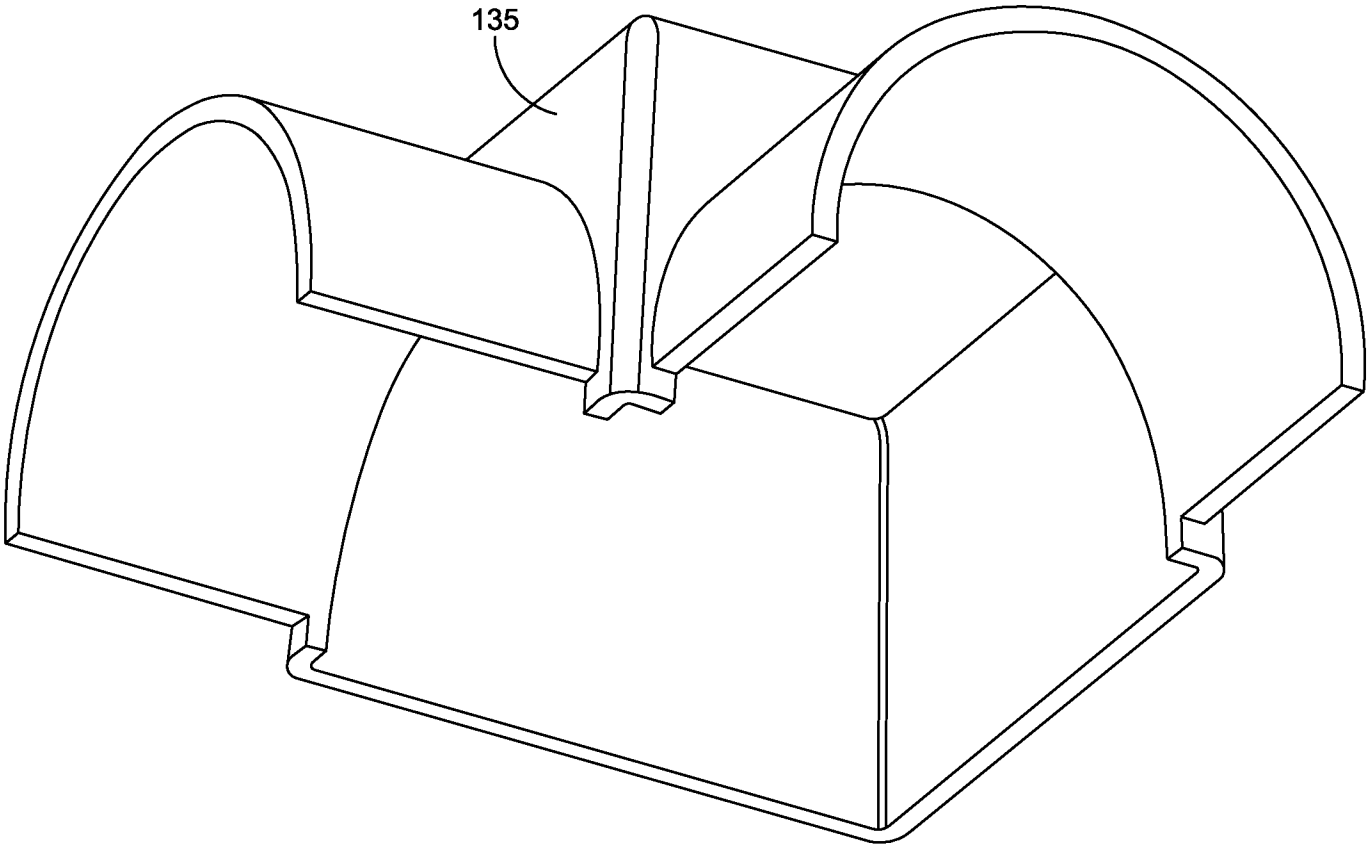
FIG. 10J is perspective view of yet another diffuser in accordance with one or more aspects of the disclosure.
Figure 11:
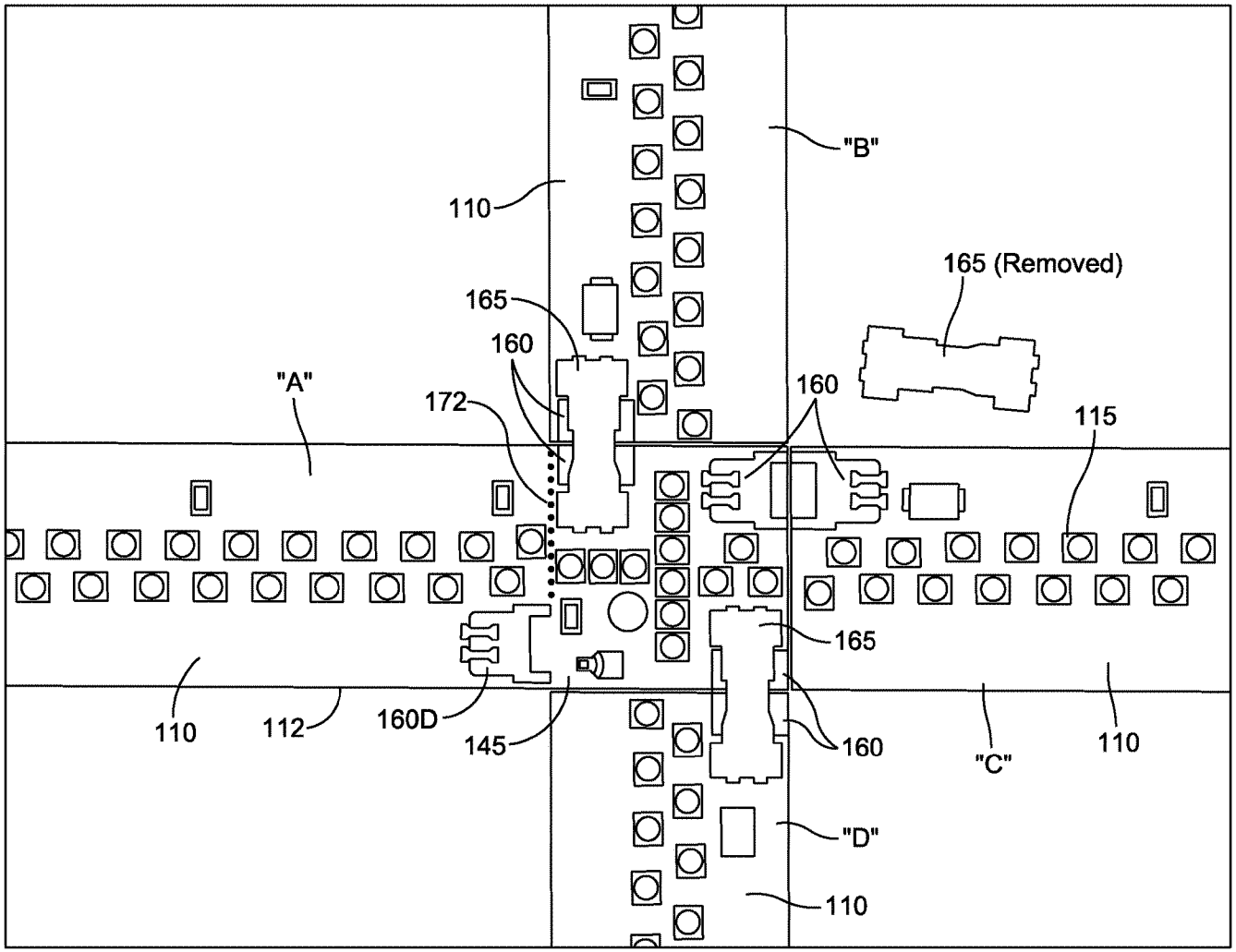
FIG. 11 is a top view of a lighting module in accordance with one or more aspects of the disclosure.

FIG. 10E shows a side and top view of another embodiment of a diffuser 135 that is configured to fit to an intersection region of two T-bars, and therefore may cover an intersection region of three lighting modules, such as the lighting modules of the type shown in FIG. 11. Further, in reference to FIGS. 7A-7C and 8, this embodiment of the diffuser may cover a connection module 145 and a portion of four separate lighting modules 110. In accordance with at least one embodiment, the diffuser 135 shown in FIG. 10E is configured as a splice, as described herein, and may thus be designed to at least partially cover one or more underlying diffuser sections associated with a respective lighting module. FIGS. 10I and 10J show a top perspective view and a bottom perspective view, respectively, of a diffuser 135 that is similar to the diffuser shown in FIG. 10E, but does not include attachment clips, and is configured to accommodate two perpendicular lighting modules 110 (FIG. 11) or two lighting modules 110 and a connection module 145 (FIGS. 7A-7C and 8) (also arranged perpendicular). According to a further embodiment, the diffuser 135 shown in FIGS. 10I and 10J may also be configured to have feet that do not extend down below the lower edge of the two right angle noses.

Figure 10F:
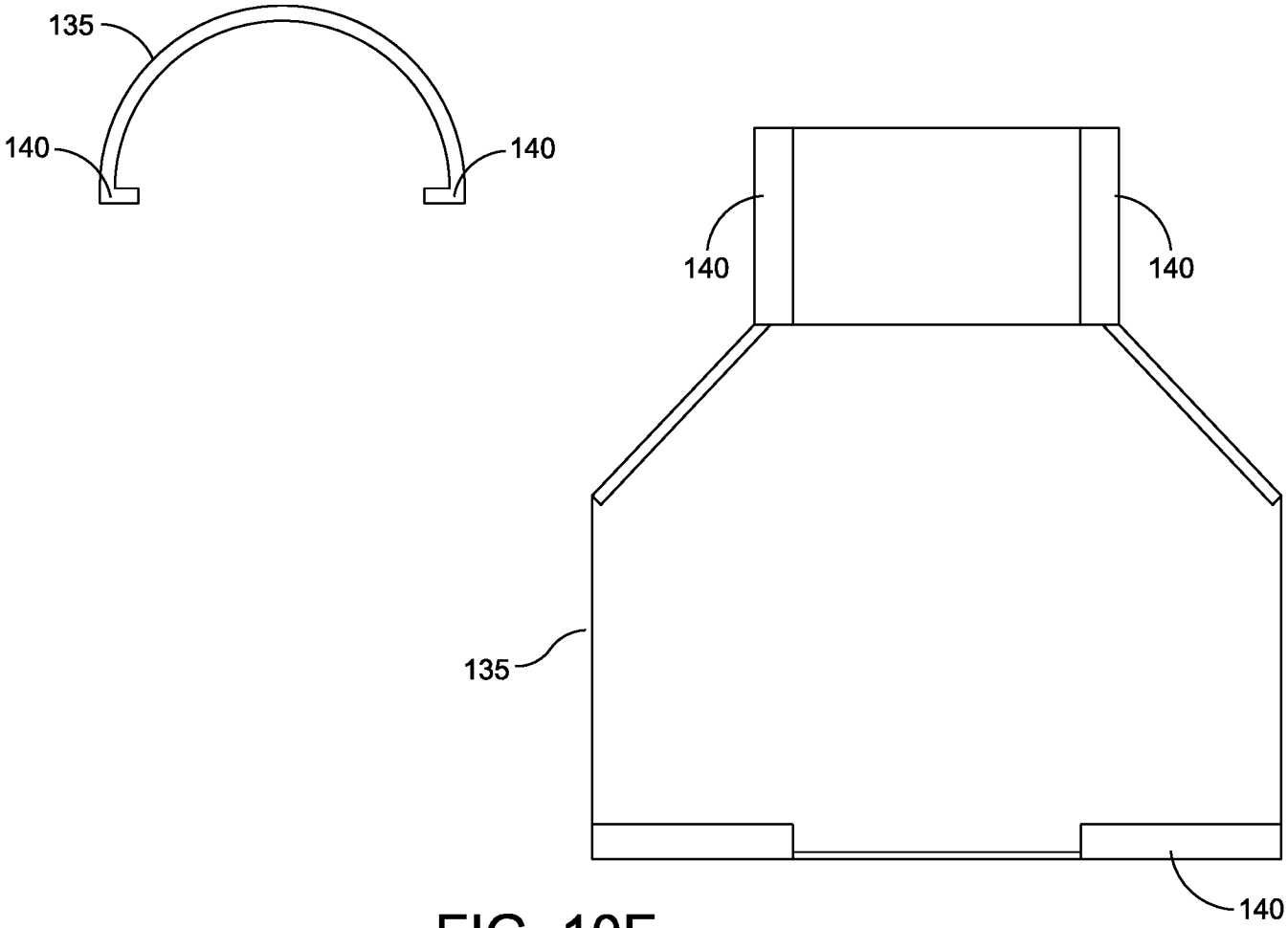
FIG. 10F is a side and top view of yet another diffuser in accordance with one or more aspects of the disclosure.

FIG. 10F is a side and top view of another embodiment of a diffuser 135. This embodiment of the diffuser 135 may be configured to cover an intersection region of three lighting modules, such as the lighting modules of the type shown in FIG. 11, or may accommodate three lighting modules 110 connected to a connection module 145, such as the modules shown in FIGS. 7A-7C and 8. Further, one side of the diffuser 135 may be configured to accommodate at least one conductive wire 170 exiting or entering a lighting module 110 and/or connection module 145 positioned in the center of the structure. This design may also be used as a splice and therefore fit over a portion of an underlying diffuser, as described above.

Figure 10G:
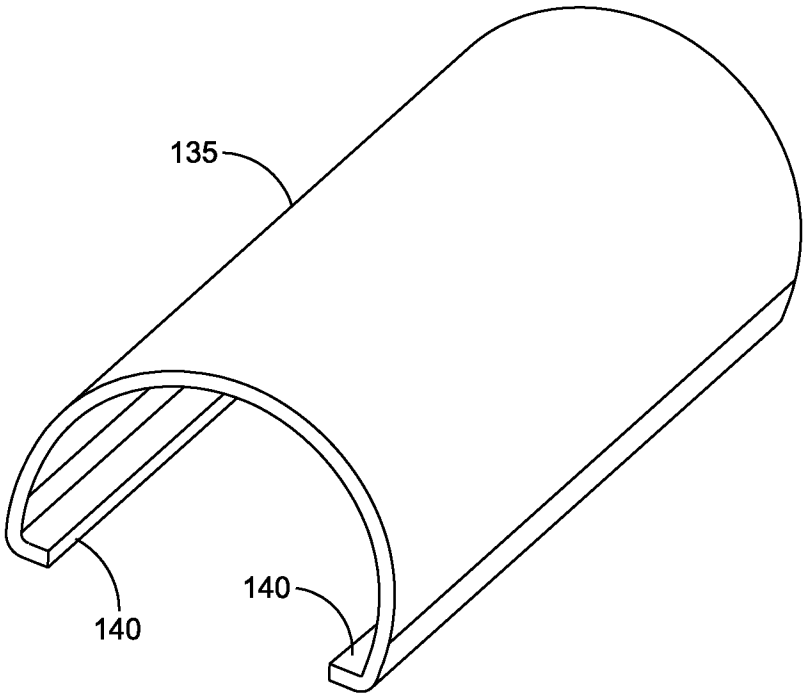
FIG. 10G is a perspective view of yet another diffuser in accordance with one or more aspects of the disclosure.
Figure 10H:
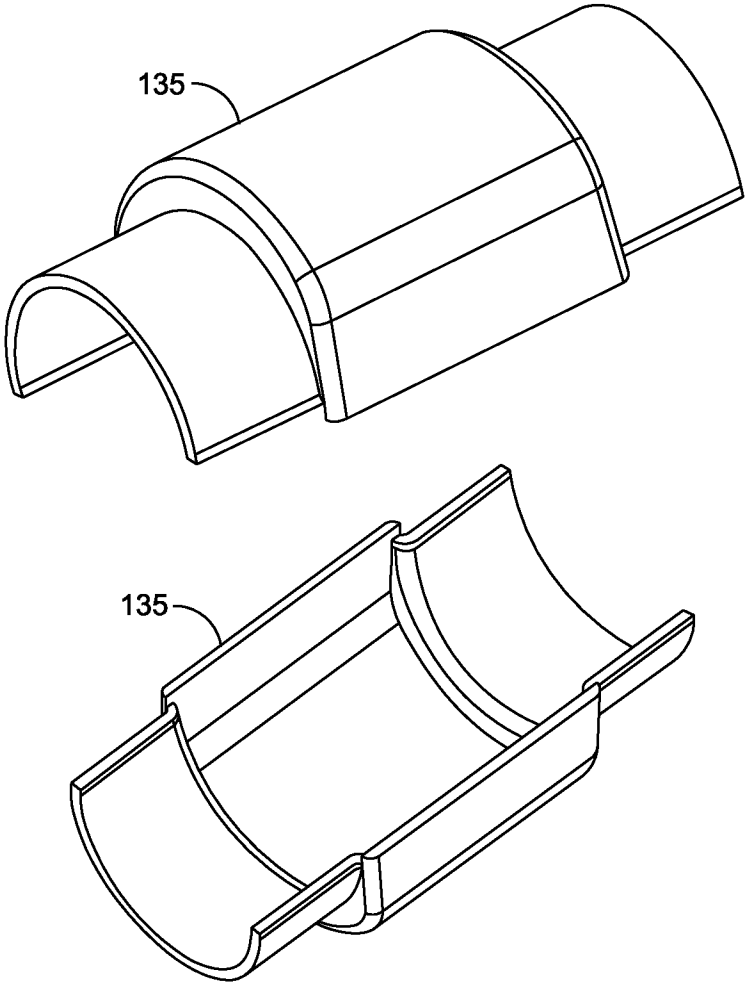
FIG. 10H is a perspective view of yet another diffuser in accordance with one or more aspects of the disclosure.

FIG. 10G is a diffuser 135 that is configured to cover at least a portion of a length of a lighting module 110, such as the lighting module shown in FIGS. 3-6. In certain instances this diffuser is configured to fit under or over the splice style diffusers discussed herein. This version of the diffuser 135 also includes at least one attachment clip 140 for attaching to the T-bar 105. The height of the hemispherical region may be altered to accommodate various designs and accommodate splice style diffusers positioned over or under this diffuser.

FIG. H is a top and bottom perspective view of a diffuser 135 that is similar to that shown in FIG. 10A, but further includes a raised portion that functions as a splice for interconnecting longer straight sections of lighting modules. This design adds versatility and reduces manufacturing costs, since the number of different lengths of diffuser that need to be stocked is decreased. For example, diffusers of 1-foot and 2-foot lengths may be manufactured and stocked, with the splice positioned up to every 2 or 4 feet along a length of installed modules. Further, this design allows for the accommodation of an intersecting T-bar positioned perpendicular to the longitudinal axis of the module.

According to various embodiments, the diffuser may be a splice design that is configured to fit under other longer diffuser sections such that the longer diffuser sections overlap the splice. For example, the splice diffuser configurations discussed above in reference to FIGS. 10A-C, E, and F may each be constructed and arranged to fit under, instead of over, portions of diffusers associated with the longer sections of lighting modules. This type of configuration simplifies the manufacturing process and reduces costs without any negative impact on functionality. For instance, the splice diffusers shown in FIGS. 10H-10J do not include attachment clips 140, and therefore may be configured to fit under other longer diffuser sections that do include the attachment clips. The longer sections may therefore "hold" the splice regions to the T-bar(s). Further, one or more sections or features of the lower portions of the diffuser may be configured to straddle the width of the horizontal face of the T-bar and thereby "lock" the splice squarely over an intersection against any translational or rotational misalignment.

Figure 5:
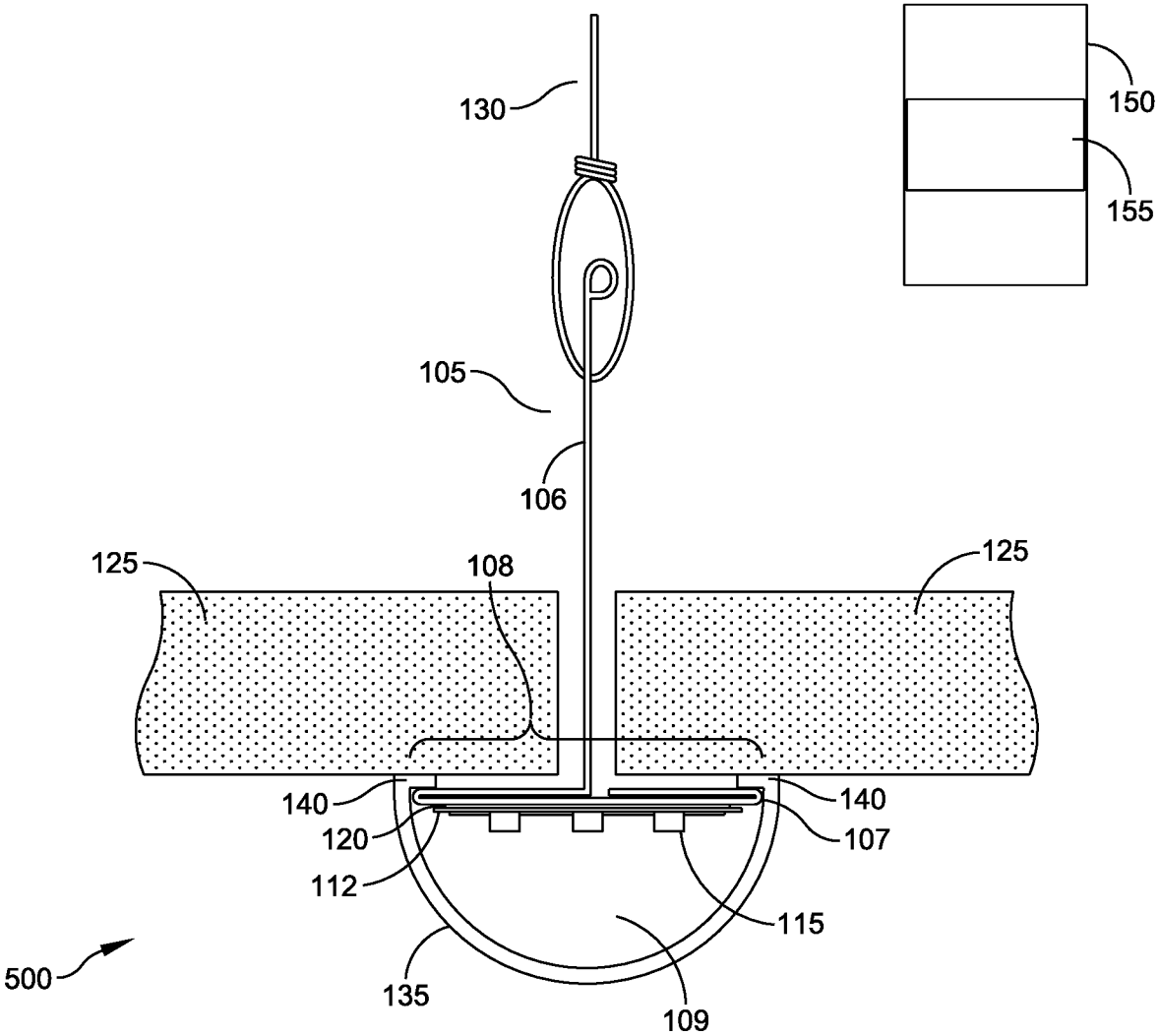
FIG. 5 is a generalized cross-sectional view of yet another lighting system in accordance with one or more aspects of the disclosure.

Referring to FIG. 5, another alternative embodiment is shown for a lighting system 500 that is similar to that shown in FIG. 3, but illustrates the use of a thin, flexible conductive substrate 112. The conductive substrate 112 in this embodiment comprises one or more layers of polyimide material that is configured to withstand reflow soldering temperatures that are used to attach the Surface Mount (SMT) parts, such as the light source 115. One advantage of this arrangement is that the flexibility of the conductive substrate 112 allows for it to conform to any irregularities in the supporting T-bar 105. The reduced thickness in the conductive substrate 112 also allows for a reduced thickness or amount of required material in the attachment member 120. Further, the attachment member 120 may be pre-applied to the polyimide strip comprising the conductive substrate 112. The flexible conductive substrate 112 may take the form of a film or a tape, and may be constructed from materials such as polyimide, such as Kapton®, PEEK (polyether ether ketone), polyester, or any other suitable flexible material that is capable of functioning as the conductive substrate as discussed herein.

Figure 6:
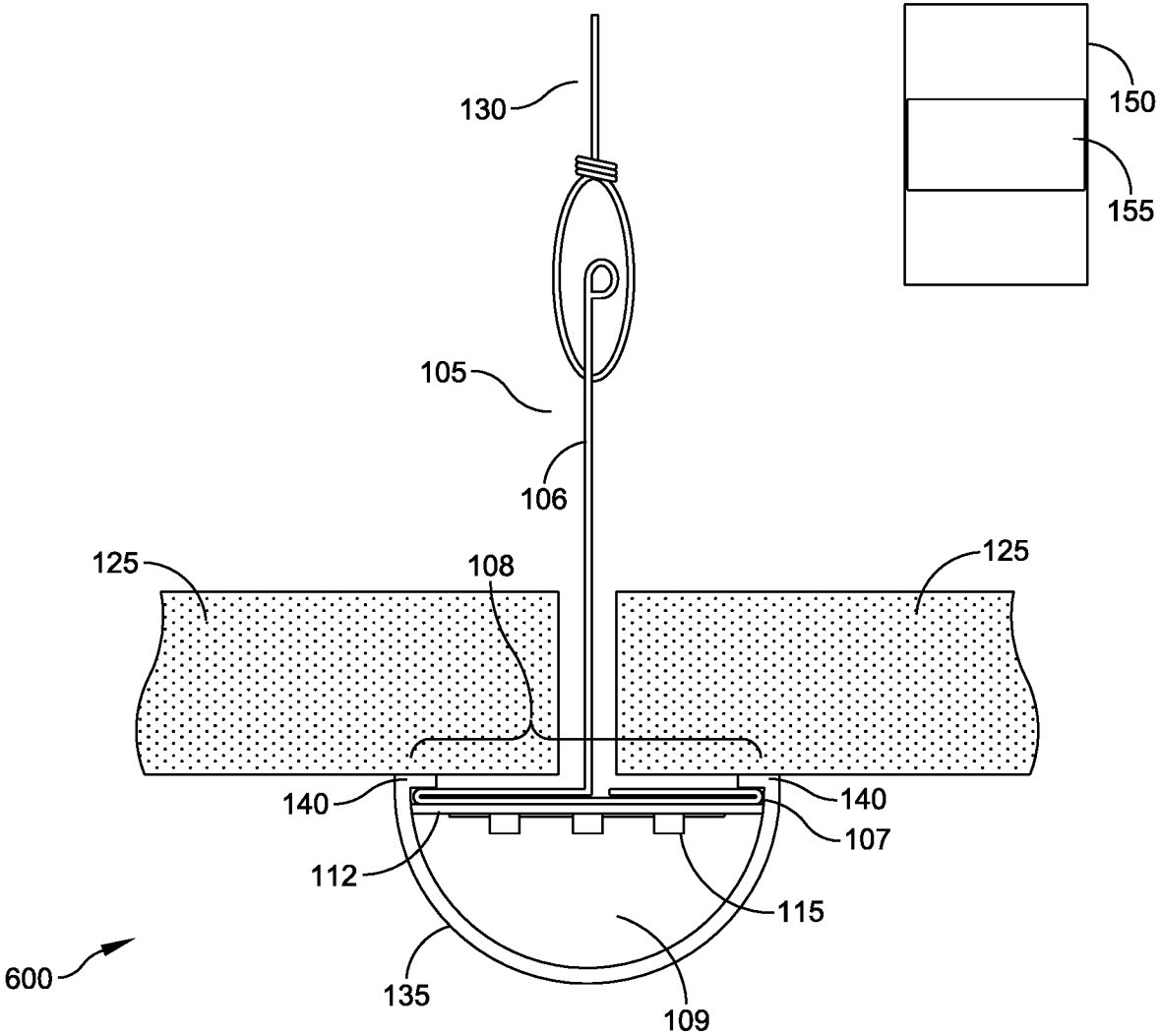
FIG. 6 is a generalized cross-sectional view of yet another lighting system in accordance with one or more aspects of the disclosure.

Referring now to FIG. 6, yet another alternative embodiment is shown for a lighting system 600 that is similar to that shown in FIG. 3, but includes a T-bar 105 that serves as the conductive substrate 112. In this embodiment, the outer surface of the horizontal section of the T-bar 107 is covered or otherwise comprises a curable or fired liquid or powder compound that is configured to serve as a heat resistant insulating layer. Copper foil tape may be etched or cyclically die cut and then bonded to the outer surface of the T-bar using an adhesive or other attachment means. For example, adhesive may be printed onto portions of the copper foil that are designed to remain on the surface of the T-bar. When the tape is transferred to the T-bar and the backer tape and unwanted copper material is removed, the remaining copper foil functions as the foundation for the circuitry of the conductive substrate 112 and is used to connect and attach soldered SMT components, such as surface mount LEDs, connectors, and other parts. This copper foil may then be bonded to the insulating outer surface of the T-bar using pressure and/or heat. In some instances, a solder mask may be used and applied as a liquid or film and then processed to leave desired sections of copper foil that are to be used to connect with subsequently mounted and reflow soldered SMT components. This embodiment may prove useful in new construction or in renovations where new ceiling grid components are to be installed.

Referring to FIG. 11, and as mentioned above, according to at least one embodiment the lighting module 110 and the connection module 145 are included on a single or common conductive substrate 112. Including the lighting module 110 and the connection module 145 into one integrated structure streamlines and reduces costs associated with the manufacturing process. According to one embodiment, the connection module 145 is integrated as a terminal portion of the lighting module 110, which may be optionally removed. In certain embodiments, both ends of the lighting module 110 may be configured to include a connection module 145. According to some embodiments, the terminal portion may be physically removed by using the separation feature 172, such as by cutting or snapping along a scribe line such as the one shown in FIG. 11. The separated entities may then be utilized independently. For example, the lighting module 110 marked as "A" includes at least one end that is configured to function as the connection module 145 discussed above. As removed, the remaining portion of the lighting module may be used, for example, to chain to another lighting module, and the removed portion may be used, for example, for right angle bends, e.g., by attaching two adjacent lighting modules. The terminal end of the lighting module 110 corresponding to the connection module 145 includes at least one connector 160. This removable portion includes three connectors that are each disposed on the conductive substrate 112 and proximate one edge of the end portion of the module 110, and each connector is configured to accommodate an interconnection device 165. Thus, the connection module portion (otherwise referred to as the removable portion) of the lighting module may mechanically and electrically attach to a maximum of three separate lighting modules. In the embodiment shown in FIG. 11, the connector 160 is a socket connector, which in the embodiment shown in FIG. 11 includes a floating plug structure (a non-limiting example including the commercially available DF59 series) and the interconnection device 165 is a plug connector, such as the removable snap-on interconnect jumper (such as the commercially available DF59 series) shown in FIG. 11, and as understood by those skilled in the art. The socket and plug connector configuration is configured to tolerate small amounts of mechanical misalignment and can therefore absorb small errors in alignment. This makes it useful in applications that require longer lengths of ceiling grid structure, where small repeated dimensional inconsistencies can accumulate, and helps accommodate small lateral and vertical section-to-section misalignments. Further, this built-in tolerance aids in accommodating the effects of thermal cycling and mismatched coefficients of thermal expansion associated with the materials used to make the T-bar and the conductive substrate. In addition, the removable interconnection device 165, which in this instance includes a snap-in type of assembly, allows for sections to be disengaged from one another more readily than a pin and socket connector type of connection assembly. This may be useful for removing or replacing an arbitrary module, since the pin and socket type of connection requires removing each module, starting from a dead end and working toward the module of interest. Further, connecting power to an arbitrary lighting module is also possible with the socket and plug connection configuration. This ability to connect power to an arbitrary module may also reduce the complexity and associated costs of the corresponding diffuser. In addition, the ability to electrically isolate an array of modules may be enhanced, since the socket and plug connector arrangement may be selectively removed between physically adjacent modules to define multiple electrically isolated configurations that are each grouped to require up to 100 VA of power.

The lighting module 110 marked as "A" in FIG. 11 also includes a fourth connector 160D positioned outside the region that permits the lighting module, once the connection module portion is removed, to connect to another lighting module. For instance, the connector marked as 160D may be disposed adjacent to a separation feature 172, such as the scribe line shown in FIG. 11. In the alternative, the fourth connector 160D may function as a mid string power connection. Once the portion of the lighting module 110 that functions as the connection module 145 is removed via the separation feature 172, the end of the lighting module 110 is configured to be similar to the second (opposite) end of lighting module "A", which looks like the ends of the lighting modules 110 corresponding to "B," "C," and "D." The fourth connector 160D may then be used in combination with an interconnection device 165 to attach to the connection module portion of another lighting module. For example, the equivalent of the fourth connector 160D (on "A") is shown on the ends of each of lighting modules "B," "C," and "D." Note that the interconnection module 165 that snaps into the connectors 160 that electrically and mechanically attach the lighting module 110 labeled "C" to "A" has been removed for purposes of illustration. The fourth connector 160D may also be used in combination with an interconnection device to attach to another lighting module, i.e., the end of the lighting module that doesn't include the removable portion. Thus, power can be routed to or from the connection module end of the lighting module to any combination of up to three physically adjacent lighting modules as determined by the placement (or not) of the interconnection device. The removable portion of the lighting module allows for an endless variety of different configurations to accommodate many different applications. Once connected using the connector 160 and interconnection device 165, a small gap or space may be present between coupled modules, as shown between module "A" and each of "B," "C," and "D."

In accordance with at least one embodiment, the connectors 160 may be disposed on the conductive substrate 112 of the lighting module 110 in axial symmetry. For example, in reference to FIG. 11, a position of the connectors 160 positioned on the visible end of lighting module "A" relative to a connector 160 positioned on the opposite end of "A" (similar to the position of the connectors 160 on "B," "C," and "D") is maintained as the conductive substrate 112 of the lighting module "A" is rotated by a multiple of 90° about an axis perpendicular to a plane of the conductive substrate 112.

The lighting modules 110 in FIG. 11 also include at least one light source 115, which in this embodiment includes a plurality of LEDs that are clustered near the longitudinal center line of the module. In certain instances, such as in applications where a diffuser has a curved outer surface (i.e., see FIGS. 3-6) this arrangement allows for the maximum distance between the diffuser and the underlying LEDs, which results in the appearance of the light emitted from the diffuser to be less point-like, i.e., less like a discrete point-source of light.

According to another embodiment, the lighting module 110 may include one or more features that may assist or otherwise ease installation of the lighting system into a grid ceiling structure. For instance, the lighting module "A" of FIG. 11 includes a circular hole positioned on the removable portion that corresponds to the connection module 145. This hole may serve a number of purposes. For example, it may be used as a guide for drilling holes into the underlying T-bar, such that the hole in the T-bar is positioned to just miss the vertical section 106 of the T-bar (see FIGS. 3-6) as well as the two right angle intersecting cross T-bars. Thus, the hole opens into a void created by the space between the vertical section of the T-bar and the edge of the ceiling tile 125 (which typically has a tile dimension that is undercut). Further, a wire leaded plug may be inserted into the connector 160D, and the associated conductive wires 170 may be routed through the hole in the lighting module and then through the hole in the underlying T-bar and finally into the void region described above. The conductive wires 170 are thus located above the ceiling tiles and the un-terminated ends may be routed to a power supply 150. This configuration may alleviate the need to create diffusers with a more bulbous splice design (to accommodate the wiring, such as those shown in FIGS. 10B, D, and F), which reduces manufacturing costs.

As should be appreciated by those skilled in the art, the light source 115 may be a source of heat. For example, an LED, being a semiconductor, is nearly a point source of heat, and in certain instances, may not be allowed to exceed temperatures of 85-150° C. According to some embodiments, the diffuser 135 may function to assist in dispersing heat. According to one example, heat removal may be augmented by forcing air through the channel 109 (see, for example, FIGS. 3-6) that exists between the inside edge of the diffuser 135 and the light source 115. For example, air may be forced into the channel 109 at one location and may exit at another location, such as at the opposite end of the channel or at punch slots distributed in the outer surface of the diffuser. Further, heat conducted by the diffuser 135 may be transferred to ambient by conduction and radiation from the emitting surface of the light source 115. Heat may also be dispersed using conductive and radiative transfer means by the inherent installation of the lighting system 300 in combination with the grid ceiling system. For example, heat produced by the light source 115 may transfer through the conductive substrate 112 to the attachment member 120 and then to the T-bar 105. Air surrounding the vertical section 106 of the T-bar 105 and air above the ceiling tiles 125 may function to transfer a sufficient amount of heat away from the lighting system 100.

According to one or more embodiments, the lighting systems discussed herein may be controlled using one or more control circuits. For example, a control circuit may include one or more lighting systems and one or more switch devices that are in communication with the power supply of the lighting system. The switch device functions to control the flow of electrical current from the power supply to one or more lighting and/or connecting modules. The switch device may also include a dimmer mechanism, so that a user can vary the luminance of one or more lighting systems. The switch device may be positioned at a wall or other location accessible to a user. According to some embodiments, the control circuit may further include a controller that functions as a switch device. The controller may include a computer device that can be programmed or otherwise configured to control the flow of electrical current to one or more lighting systems. For example, the controller may be programmed to turn one or more lighting systems on at certain times of the day, or to turn off when a user leaves the room. In addition, a user may interface with the controller to turn lights on and off and/or program the controller. The controller may also be configured to allow a user to control one or more lighting systems remotely. For example, the controller and one or more lighting systems may be configured with an RF or Infrared receiver so that a user can use a remote control device to turn lights on and off. According to some embodiments, control for on/off capability and dimming may be at a primary voltage level which is not Class 2, and in other embodiments one or both of the on/off capability and dimming may be Class 2. According to some embodiments, the controller may be integrated with a security system, such as a residential home security system. For example, the lighting system may be integrated with an emergency notification function that is part of the security system. According to some embodiments, the controller may control several lighting systems, where each lighting system does not exceed 100 VA. The lighting systems may be positioned in one location, such as a room, or may be located at different locations, such as in different rooms of a home or office building.

The lighting systems discussed in the examples and embodiments above are also simple to install and generally do not require the services of a licensed electrician. A user may decide on a particular lighting design for a room or other space based on the lighting application and the threshold voltage limitations for an installation that is Class 2 compliant. Once the design is established, one or more conductive substrates 112 (and light source 115) of the connection module 145 and the lighting module 110 are secured to the T-bar 105 in the desired layout using the attachment member 120. A power supply 150, which may be positioned external to the lighting system, such as in the structural ceiling or walls of the building as shown in FIG. 12, may provide electrical current to the lighting system through one or more connection modules. The user may then attach the connection modules to the power supply 150, which may include a transformer 155. As shown in FIG. 12, the transformer 155 may be integrated with the power supply 150 as one device.

Although the above examples use lighting as an application for the low voltage functionality, other forms of low voltage applications are also within the scope of this disclosure. For example, in addition to lighting, other low voltage applications that fall within the scope of this disclosure include ambient lighting applications, such as security lighting, (e.g., exit lights), safety applications, such as smoke detectors, carbon monoxide (CO) detectors, carbon dioxide ($CO_2$) detectors, radiation detectors, occupancy detectors, and the like. As discussed above, one or more of these types of applications may further be integrated with a security system to assist in emergency notification. Other types of suitable applications may include functionality related to communication, such as RF or Infrared sensors or other wireless applications. Low voltage applications may also include air filtering and/or cleaning.

The lighting systems disclosed herein offer several advantages over other lighting options currently available on the market. For example, the lighting systems are lightweight and are classified as low voltage or Class 2 compliant, which allows for simple and economical installation. The lighting systems may also be arranged in a wide number of different configurations, so long as the voltage limitation for a Class 2 electrical installation is not exceeded. Further, a low light loss diffuser may be used in combination with the light source of the lighting system to allow for an even distribution of emitted light and/or to create different lighting effects, such as colored light. The use of a number of low power LEDs also allows for intrinsic and uniform removal of heat. When used with a diffuser, the lighting system may also be characterized by the absence of "hot spots." The lighting systems may be implemented into a grid ceiling system of an existing structure, such as a home or office to supplement or replace existing lighting fixtures, or may be incorporated into the design of a new building.

In certain applications, the disclosed systems and methods may also be suitable for use in high voltage, Class 1 applications. These types of applications may require the services of a licensed electrician and may also require components that satisfy electrical requirements established by a Nationally Recognized Testing Laboratory (NRTL). For example, a user may desire to supplement or replace an existing light installation in a room using one or more of the lighting systems disclosed herein, with the exception that each lighting system exceeds 100 VA.

Having thus described several aspects of at least one example, it is to be appreciated that various alterations, modifications, and improvements will readily occur to those skilled in the art. For instance, examples disclosed herein may also be used in other contexts. Such alterations, modifications, and improvements are intended to be part of this disclosure, and are intended to be within the scope of the examples discussed herein. Accordingly, the foregoing description and drawings are by way of example only.

What is claimed is:

1. A lighting system for a grid ceiling, the grid ceiling including a plurality of T-bar sections interconnected at an intersection region of the grid ceiling, the lighting system comprising:

a first lighting module having a first end and a second end, the first lighting module including at least one low voltage light source electrically connected to a conductive surface of a first substrate and a first connector disposed on the conductive surface of the first substrate proximate the first end of the first lighting module, the first lighting module being constructed and arranged to be disposed proximate a first T-bar section of the plurality of T-bar sections of the grid ceiling;

a first connection module including a second substrate and a second connector disposed on a conductive surface of the second substrate, the first connection module being configured to electrically and mechanically couple to the second end of the first lighting module to transfer power to or from the first lighting module, the first connection module being constructed and arranged to be disposed proximate the intersection region of the grid ceiling;

a first diffuser constructed and arranged to cover the first lighting module and diffuse light emanating from the at least one low voltage light source, wherein the first diffuser has a first attachment clip and a second attachment clip, the first and second attachment clips being configured to secure the first diffuser to a horizontal section of the first T-bar section; and a second diffuser constructed and arranged to cover the first connection module, wherein the second diffuser includes a plurality of attachment clips configured to secure the second diffuser to at least the first T-bar section.

2. The lighting system of claim 1, wherein the first substrate of the first lighting module and the second substrate of the first connection module are formed as portions of a common substrate, and wherein the common substrate includes at least one separation feature formed on the common substrate that permits the first substrate of the first lighting module to be physically separated from the second substrate of the first connection module.

3. The lighting system of claim 2, wherein the first lighting module further includes a third connector disposed on the conductive surface of the first substrate proximate a second end of the first lighting module that is opposite the first end and adjacent the at least one separation feature.

4. The lighting system of claim 3, wherein the first connection module includes at least one low voltage light source electrically connected to the conductive surface of the second substrate.

5. The lighting system of claim 4, further comprising a second lighting module having a first end and a second end, the second lighting module including at least one low voltage light source electrically connected to a conductive surface of a third substrate and a fourth connector disposed on the conductive surface of the third substrate proximate the first end of the second lighting module, the second lighting module being constructed and arranged to be disposed proximate a second T-bar section of the plurality of T-bar sections that intersects with the first T-bar section at the intersection region of the grid ceiling, the fourth connector being configured to electrically and mechanically connect to the second connector of the first connection module to transfer power to or from the first lighting module.

6. The lighting system of claim 4, wherein the first connection module includes four edges, wherein the second connector is disposed on the conductive surface of the second substrate proximate a first edge of the four edges, and wherein the first connection module further includes a third connector disposed on the conductive surface of the second substrate proximate a second edge of the four edges, the second edge being perpendicular to the first edge.

7. The lighting system of claim 4, wherein the first connection module includes four edges, wherein the second connector is disposed on the conductive surface of the second substrate proximate a first edge of the four edges, and wherein the first connection module further includes a fourth connector, the third connector being disposed on the conductive surface of the second substrate proximate a second edge of the four edges, the fourth connector being disposed on the conductive surface of the second substrate proximate a third edge of the four edges, the first edge being perpendicular to the second edge and the third edge.

8. The lighting system of claim 1, wherein the first lighting module includes a plurality of first lighting sub-modules sharing the first substrate, each first lighting sub-module of the plurality of first lighting modules including at least one low voltage light source electrically connected to the conductive surface of the first substrate, each of the plurality of first lighting sub-modules being electrically connected together via the conductive surface of the first substrate.

9. The lighting system of claim 8, wherein the first substrate includes at least one electrical isolation feature provided on the first substrate to allow a first lighting sub-module of the plurality of first lighting sub-modules to be electrically isolated from an adjacent first lighting sub-module of the plurality of first lighting sub-modules.

10. The lighting system of claim 9, wherein the first substrate further includes at least one separation feature formed on the first substrate to allow the first lighting sub-module to be physically separated from the adjacent first lighting sub-module.

11. The lighting system of claim 1, further comprising:

a first attachment member configured to secure the first lighting module proximate the first T-bar section; and a second attachment member configured to secure the first connection module proximate the intersection region, wherein at least one of the first and second attachment members includes one of a thermally conductive adhesive, double-sided adhesive thermally conducting tape, and a thermally conductive magnetic attachment member.

12. The lighting system of claim 1, wherein the first diffuser includes at least one longitudinal ridge configured to secure the first lighting module in position proximate the first T-bar section.

13. The lighting system of claim 1, wherein the first diffuser includes a plurality of longitudinal ridges configured to secure the first lighting module in registration with the first T-bar section.

14. The lighting system of claim 1, wherein the plurality of attachment clips is configured to secure the second diffuser to the first T-bar section and at least one other T-bar section of the plurality of T-bar sections interconnected at the intersection region of the grid ceiling.

15. The lighting system of claim 1, wherein a portion of the second diffuser is constructed and arranged to overlap with a portion of the first diffuser.

16. The lighting system of claim 1, wherein the first diffuser is configured to secure the first lighting module in registration with the first T-bar section.

17. The lighting system of claim 1, wherein the first connector is one of a pin connector and a socket connector, and the second connector is the other of the pin connector and the socket connector.

18. The lighting system of claim 1, wherein the first connector and the second connector are socket connectors, and wherein the lighting system further include a plug connector to electrically and mechanically couple the first connector with the second connector.

19. The lighting system of claim 1, wherein the first connection module includes four edges, wherein the second connector is disposed on the conductive surface of the second substrate proximate a first edge of the four edges, and wherein the first connection module further includes a third connector disposed on the conductive surface of the second substrate proximate a second edge of the four edges, the second edge being one of perpendicular and parallel to the first edge.

20. The lighting module of claim 1, where the first connection module includes four edges, wherein the second connector is disposed on the conductive surface of the second substrate proximate a first edge of the four edges, and wherein the first connection module further includes a third connector and a fourth connector, the third connector being disposed on the conductive surface of the second substrate proximate a second edge of the four edges, the fourth connector being disposed on the conductive surface of the second substrate proximate a third edge of the four edges, the second edge being perpendicular to the first edge, and the third edge being parallel to the first edge.

21. The lighting module of claim 1, where the first connection module includes four edges, wherein the second connector is disposed on the conductive surface of the second substrate proximate a first edge of the four edges, and wherein the first connection module further includes a third connector, a fourth connector, and a fifth connector, the third connector being disposed on the conductive surface of the second substrate proximate a second edge of the four edges, the fourth connector being disposed on the conductive surface of the second substrate proximate a third edge of the four edges, and the fifth connector being disposed on the conductive surface of the second substrate proximate a fourth edge of the four edges, the second edge and the fourth edge each being perpendicular to the first edge, and the third edge being parallel to the first edge.

22. The lighting module of claim 21, wherein the second connector, the third connector, the fourth connector, and the fifth connector each includes a power conductor and a return conductor, the power conductor of the second connector being electrically connected to the power conductor of the third, fourth, and fifth connectors, and the return conductor of the second connector being electrically connected to the return conductor of the third, fourth, and fifth connectors.

23. The lighting module of claim 21, wherein the second, third, fourth, and fifth connectors are disposed on the second substrate in axial symmetry, so that a position of the second, third, fourth, and fifth connectors relative to the first connector is maintained as the second substrate of the first connector module is rotated by a multiple of ninety degrees about an axis perpendicular to a plane of the second substrate.

24. The lighting system of claim 1, wherein the first lighting module and the first connection module are constructed and arranged to be disposed on an exposed horizontal section of the first T-bar section and the intersection region of the grid ceiling, respectively.

25. The lighting system of claim 1, wherein the lighting system further includes a power supply having an input and at least one output, the power supply being configured to receive electrical power having a first voltage level at the input, and to provide electrical power having a second voltage level to each at least one output, each at least one output being constructed and arranged to provide electrical power having the second voltage level to one of the first connector and the second connector.

26. The lighting system of claim 1, wherein the substrate of the first lighting module is formed from a printed circuit board constructed and arranged to transfer heat generated from the at least one low voltage light source to the first T-bar section.

* * * * *